US009321272B2

(12) United States Patent
Mizutani et al.

(10) Patent No.: US 9,321,272 B2
(45) Date of Patent: Apr. 26, 2016

(54) LIQUID SUPPLY UNIT MOUNTING MECHANISM AND LIQUID SUPPLY UNIT

(71) Applicant: SEIKO EPSON CORPORATION, Tokyo (JP)

(72) Inventors: Tadahiro Mizutani, Shiojiri (JP); Takayuki Shiota, Kitakyusyu (JP); Atsushi Kobayashi, Matsumoto (JP); Shun Oya, Matsumoto (JP); Yoshiyuki Okazawa, Suwa (JP); Kazumasa Harada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/573,275

(22) Filed: Dec. 17, 2014

(65) Prior Publication Data

US 2015/0165777 A1 Jun. 18, 2015

(30) Foreign Application Priority Data

| | | |
|---|---|---|
| Dec. 18, 2013 | (JP) | 2013-260964 |
| Dec. 26, 2013 | (JP) | 2013-270007 |
| Dec. 27, 2013 | (JP) | 2013-272477 |
| Jan. 30, 2014 | (JP) | 2014-015767 |
| Feb. 3, 2014 | (JP) | 2014-018365 |
| Feb. 19, 2014 | (JP) | 2014-029769 |
| Feb. 21, 2014 | (JP) | 2014-031192 |
| Feb. 26, 2014 | (JP) | 2014-034847 |
| Feb. 28, 2014 | (JP) | 2014-037928 |
| Feb. 28, 2014 | (JP) | 2014-037929 |
| Mar. 7, 2014 | (JP) | 2014-045198 |
| Mar. 20, 2014 | (JP) | 2014-057360 |
| Mar. 25, 2014 | (JP) | 2014-061295 |
| Mar. 25, 2014 | (JP) | 2014-061296 |
| Mar. 25, 2014 | (JP) | 2014-061297 |
| Jun. 9, 2014 | (JP) | 2014-118344 |

(51) Int. Cl.
*B41J 2/175* (2006.01)
*B41J 2/17* (2006.01)

(52) U.S. Cl.
CPC ..... *B41J 2/1752* (2013.01); *B41J 2/175* (2013.01); *B41J 2/1714* (2013.01); *B41J 2/1753* (2013.01); *B41J 2/17523* (2013.01); *B41J 2/17526* (2013.01); *B41J 2/17553* (2013.01)

(58) Field of Classification Search
USPC ..... 347/49, 50, 85, 86, 87, 5, 9
See application file for complete search history.

(56) References Cited

U.S. PATENT DOCUMENTS 4,556,012 A 12/1985 Scrudato
5,182,581 A 1/1993 Kashimura et al.

(Continued)

FOREIGN PATENT DOCUMENTS

JP 07-148936 A 6/1995
JP 09-011500 A 1/1997

(Continued)

OTHER PUBLICATIONS

Non-Final Office Action issued on Mar. 18, 2015 in U.S. Appl. No. 14/573,192.

(Continued)

*Primary Examiner* — Lam Nguyen
(74) *Attorney, Agent, or Firm* — Stroock & Stroock & Lavan LLP

(57) ABSTRACT

A technique of enhancing attachment of a liquid supply unit to a liquid ejection device is provided. A holder structure 200 is provided as a mounting mechanism configured to cause a first ink cartridge 100*a* and a second ink cartridge 100*b* to be attachable to and detachable from a carriage 27 of a printing device 10. The holder structure 200 has a lever member 230 provided as a rotation mechanism to be rotated and thereby lock the first and the second ink cartridges 100*a* and 100*b*. The lever member 230 includes a first leg section 231*a*, a second leg section 231*b* formed away from the first leg section 231*a* and a bridging section 232 formed between the first and the second leg sections 231*a* and 231*b* to engage with a main engagement part 120 of each of the ink cartridges 100*a* and 100*b*.

17 Claims, 29 Drawing Sheets

(56) References Cited

U.S. PATENT DOCUMENTS

| | | | | |
|---|---|---|---|---|
| 5,488,401 | A | 1/1996 | Mochizuki et al. | |
| 5,552,861 | A | 9/1996 | Mizude et al. | |
| 5,619,239 | A | 4/1997 | Kotaki et al. | |
| 6,000,789 | A | 12/1999 | Takagi et al. | |
| 6,152,555 | A | 11/2000 | Nozawa et al. | |
| 6,170,941 | B1 | 1/2001 | Hara et al. | |
| 6,250,750 | B1 | 6/2001 | Miyazawa et al. | |
| 6,276,780 | B1 | 8/2001 | Carrese et al. | |
| 6,375,315 | B1 | 4/2002 | Steinmetz et al. | |
| 6,439,491 | B1 | 8/2002 | Liao | |
| 6,739,708 | B2 | 5/2004 | Studer et al. | |
| 6,776,479 | B2 | 8/2004 | Ardito et al. | |
| 6,899,417 | B1 | 5/2005 | Shinada et al. | |
| 7,066,587 | B2 | 6/2006 | Andersen et al. | |
| 7,178,909 | B2 | 2/2007 | Yoshiyama et al. | |
| 7,258,431 | B2 | 8/2007 | Shinada et al. | |
| 7,300,142 | B1 | 11/2007 | Usui et al. | |
| 7,445,320 | B2 | 11/2008 | Jung et al. | |
| 8,297,738 | B1 | 10/2012 | Kodama et al. | |
| 8,297,739 | B1 * | 10/2012 | Kodama et al. | 347/49 |
| 2002/0118262 | A1 | 8/2002 | Seino et al. | |
| 2002/0158948 | A1 | 10/2002 | Miyazawa et al. | |
| 2004/0246317 | A1 | 12/2004 | Hayashi et al. | |
| 2005/0168549 | A1 | 8/2005 | Shinada et al. | |
| 2006/0066696 | A1 | 3/2006 | Matsumoto et al. | |
| 2006/0290757 | A1 | 12/2006 | Shinada et al. | |
| 2008/0049080 | A1 | 2/2008 | Hayashi et al. | |
| 2008/0049081 | A1 | 2/2008 | Hayashi et al. | |

FOREIGN PATENT DOCUMENTS

| | | | |
|---|---|---|---|
| JP | 10-016249 | A | 1/1998 |
| JP | 10-278290 | A | 10/1998 |
| JP | 10-286972 | A | 10/1998 |
| JP | 2000-033707 | A | 2/2000 |
| JP | 2000-190522 | A | 7/2000 |
| JP | 2001-121715 | A | 5/2001 |
| JP | 2001-253087 | A | 9/2001 |
| JP | 3248831 | B | 11/2001 |
| JP | 2002-292905 | A | 10/2002 |
| JP | 2003-072099 | A | 3/2003 |
| JP | 2004-230704 | A | 8/2004 |
| JP | 2005-028883 | A | 2/2005 |
| JP | 2005-125559 | A | 5/2005 |
| JP | 2006-088650 | A | 4/2006 |
| JP | 2006-175885 | A | 7/2006 |
| JP | 2006-247932 | A | 9/2006 |
| JP | 2006-289770 | A | 10/2006 |
| JP | 2008-074090 | A | 4/2008 |
| JP | 2008-074100 | A | 4/2008 |
| JP | 2013-141804 | A | 7/2013 |
| JP | 2013-158980 | A | 8/2013 |

OTHER PUBLICATIONS

Non-Final Office Action issued on Jun. 26, 2015 in U.S. Appl. No. 14/573,424.

* cited by examiner

200s

LIQUID SUPPLY UNIT MOUNTING MECHANISM AND LIQUID SUPPLY UNIT

CROSS-REFERENCE TO RELATED APPLICATIONS

This application claims priority to Japanese Patent Applications No. (JP) 2013-260964 filed on Dec. 18, 2013, JP 2013-270007 filed on Dec. 26, 2013, JP 2013-272477 filed on Dec. 27, 2013, JP 2014-015767 filed on Jan. 30, 2014, JP 2014-018365 filed on Feb. 3, 2014, JP 2014-029769 filed on Feb. 19, 2014, JP 2014-031192 filed on Feb. 21, 2014, JP 2014-034847 filed on Feb. 26, 2014, JP 2014-037928 filed on Feb. 28, 2014, JP 2014-037929 filed on Feb. 28, 2014, JP 2014-045198 filed on Mar. 7, 2014, JP 2014-057360 filed on Mar. 20, 2014, JP 2014-061295 filed on Mar. 25, 2014, JP 2014-061296 filed on Mar. 25, 2014, JP 2014-061297 filed on Mar. 25, 2014, and JP 2014-118344 filed on Jun. 9, 2014, entire disclosures of which are incorporated herein by reference for all purposes.

BACKGROUND

1. Technical Field

The present invention relates to a mounting mechanism for mounting a liquid supply unit.

2. Description of the Related Art

A known liquid supply unit is, for example, an ink cartridge configured to supply ink to an inkjet printer. The inkjet printer (hereinafter simply called "printer") is one type of a liquid ejection device and is provided as a printing device to eject ink droplets on a printing surface and thereby form an image. The ink cartridge is attachable to and detachable from a carriage equipped in the printer via a mounting mechanism. According to a technique disclosed in JP 2013-141804A, the ink cartridge is attached to the carriage via a holder having a lever operated to be rotated.

SUMMARY

There is a need to facilitate the attachment operation of the ink cartridges to the printer.

In order to solve at least part of the problems described above, the invention may be implemented by aspects described below.

[1] According to one aspect of the invention, there is provided a liquid supply unit mounting mechanism. The liquid supply unit mounting mechanism comprises a liquid introducing part and a rotation mechanism. The liquid introducing part may be configured to introduce a liquid supplied from a liquid supply port of a liquid supply unit. The rotation mechanism may be configured to be engaged with the liquid supply unit. The rotation mechanism may comprise a first leg section, a second leg section formed away from the first leg section, and a bridging section formed between the first leg section and the second leg section. The rotation mechanism may be configured to let the liquid supply unit stopped at the bridging section. The bridging section may be configured to be rotatable and movable in a direction away from the liquid introducing part. In the liquid supply unit mounting mechanism of this aspect, the rotation mechanism is readily rotatable and movable by the bridging section formed between the first leg section and the second leg section. This configuration enables the liquid supply unit to be readily fixed.

[2] The liquid supply unit mounting mechanism of the above aspect may further comprise an electrode assembly configured to be electrically in contact with the liquid supply unit. The electrode assembly may be located between the first leg section and the second leg section viewed in a direction of rotating and moving the bridging section. In the liquid supply unit mounting mechanism of this aspect, the rotation mechanism and the electrode assembly are intensively arranged. This configuration enhances the space use efficiency and allows for downsizing of the liquid supply unit mounting mechanism.

[3] In the liquid supply unit mounting mechanism of the above aspect, a distance from the bridging section to a rotation axis of the rotation mechanism may be longer than a distance from the bridging section to the electrode assembly. The liquid supply unit mounting mechanism of this aspect reduces the force for rotating and moving the rotation mechanism, thus facilitating attachment of the liquid supply unit.

[4] In the liquid supply unit mounting mechanism of the above aspect, the electrode assembly may be configured to have a plurality of electrodes arranged to be electrically in contact with the liquid supply unit. The rotation mechanism may have an extension section provided on at least the first leg section. The extension section may have an outer peripheral edge located at a position closer to an area where the liquid supply unit is attached than at least part of the plurality of electrodes, in a state that the liquid supply unit is not attached to the liquid supply unit mounting mechanism. The liquid supply unit mounting mechanism of this aspect enables the electrode assembly to be protected by the extension section.

[5] In the liquid supply unit mounting mechanism of the above aspect, the extension section may be extended along an attachment direction of the liquid supply unit in the course of attachment of the liquid supply unit. In the liquid supply unit mounting mechanism of this aspect, the extension section suppresses the electrode assembly from hitting against any location other than a specified area of the liquid supply unit which the electrode assembly is to come into contact with, in the course of attachment of the liquid supply unit. This enhances the protection of the electrode assembly.

[6] In the liquid supply unit mounting mechanism of the above aspect, the bridging section may be configured to have an abutting part which comes into contact with the liquid supply unit, such as to limit move of the liquid supply unit in a direction of making the liquid supply port of the liquid supply unit away from the liquid introducing part, in a state that the liquid supply unit is attached to the liquid supply unit mounting mechanism. The liquid supply unit mounting mechanism of this aspect enhances the fixation of the liquid supply unit.

[7] In the liquid supply unit mounting mechanism of the above aspect, the abutting part may have a first projection and a second projection which comes into contact with the liquid supply unit, in the state that the liquid supply unit is attached to the liquid supply unit mounting mechanism. In the liquid supply unit mounting mechanism of this aspect, the abutting part limits the move of the liquid supply unit by at least the two points, the first projection and the second projection. Therefore, the attachment of the liquid supply unit is enhanced.

[8] In the liquid supply unit mounting mechanism of the above aspect, the rotation mechanism may have a rotation limiter configured to come into contact with the liquid supply unit and thereby limit rotation and move of the bridging section toward the liquid introducing part, in a state that the liquid supply unit is attached to the liquid supply unit mounting mechanism. The liquid supply unit mounting mechanism of this aspect suppresses the bridging section from being excessively rotated and moved in a direction toward the liquid supply unit.

[9] In the liquid supply unit mounting mechanism of the above aspect, the first leg section may have a first rotating shaft member, the second leg section may have a second rotating shaft member, and the rotation mechanism may be configured to be rotatable about the first rotating shaft member and the second rotating shaft member as a rotation axis. The liquid supply unit mounting mechanism of this aspect stabilizes the rotating operation of the rotation mechanism.

[10] In the liquid supply unit mounting mechanism of the above aspect, the rotation mechanism may have a first pressing member configured to press the first leg section in a rotating direction and a second pressing member configured to press the second leg section in a rotating direction. The liquid supply unit mounting mechanism of this aspect has the pressing members provided respectively on the first and the second leg sections. This allows for downsizing of the respective pressing members.

[11] In the liquid supply unit mounting mechanism of the above aspect, the bridging section may have an operating part configured to be operable by the user to rotate the rotation mechanism and located at a middle position between the first leg section and the second leg section. The liquid supply unit mounting mechanism of this aspect suppresses inclination of the bridging section, thus enhancing the attachment of the liquid supply unit.

[12] According to another aspect of the invention, there is provided a liquid supply unit configured to be attachable to the liquid supply unit mounting mechanism of any of the above aspects. The liquid supply unit may comprise a contact area configured to come into contact with the rotation mechanism and thereby rotate and move the bridging section in a direction away from the liquid introducing part in the course of attachment of the liquid supply unit to the liquid supply unit mounting mechanism. The liquid supply unit of this aspect simplifies the operation of rotating the moving the rotation mechanism and thereby facilitates the attachment operation of the liquid supply unit to the liquid supply unit mounting mechanism of the above aspect.

[13] The liquid supply unit of the above aspect may further comprise an exterior assembly configure to have a liquid chamber formed to contain a liquid and the liquid supply port. The liquid supply unit of this aspect can be readily attached to the liquid supply unit mounting mechanism of the above aspect.

[14] The liquid supply unit of the above aspect may further comprise: a first member configured to have the liquid supply port; and a second member configured to be connectable with the first member and have a liquid chamber formed to contain a liquid inside thereof. The liquid supply unit of this aspect can be readily attached to the liquid supply unit mounting mechanism of the above aspect.

[15] The liquid supply unit of the above aspect may further comprise: a first member configured to have the liquid supply port; and a second member configured to be connected with the liquid supply port and supply a liquid through the liquid supply port. The liquid supply unit of this aspect can be readily attached to the liquid supply unit mounting mechanism of the above aspect.

The invention may be implemented by any of various aspects other than the liquid supply unit mounting mechanism and the liquid supply unit, for example, a device equipped with the liquid supply unit mounting mechanism, a system including such a device or a method of attaching the liquid supply unit.

DESCRIPTION OF EMBODIMENTS

A. First Embodiment

[Configuration of Printing Device]

Figure 1:
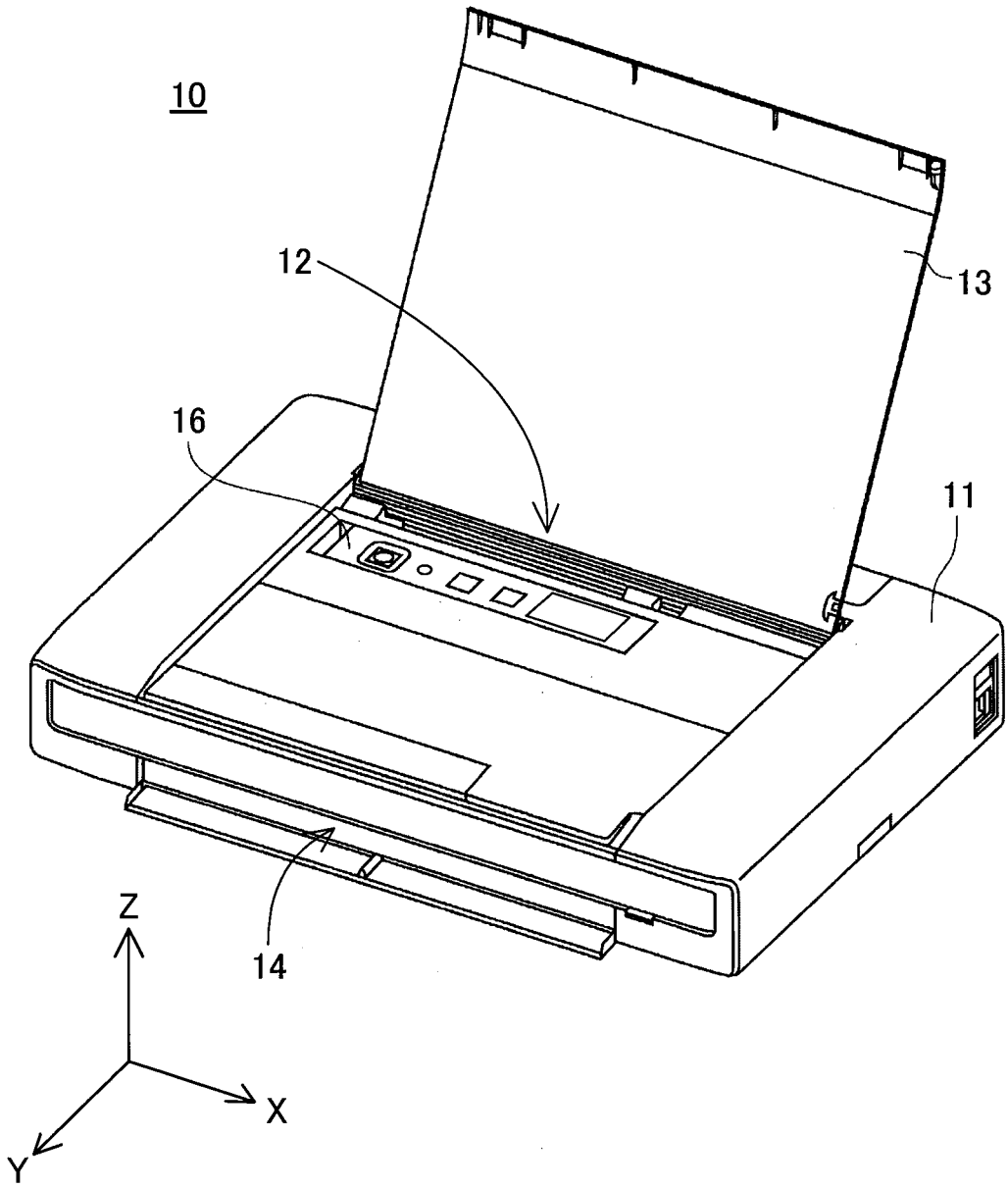
FIG. 1 is a schematic perspective view illustrating the appearance configuration of a printing device.

FIG. 1 is a schematic perspective view illustrating the appearance configuration of a printing device 10 having a mounting mechanism for an ink cartridge (hereinafter simply referred to as "cartridge") according to a first embodiment of the invention. Arrows X, Y and Z representing three different directions orthogonal to one another are illustrated in FIG. 1. The arrow X denotes a left-right direction parallel to a lateral direction (width direction) of the printing device 10 and shows a direction from left to right in the state facing the printing device 10. The arrow Y denotes a direction parallel to a front-back direction of the printing device 10 and shows a direction from backside (rear side) toward foreside (front side). The arrow Z denotes a height direction of the printing device 10 and shows a vertically upward direction relative to a mounting surface where the printing device 10 is placed. In other drawings used for the description herein, the arrows X, Y and Z corresponding to those of FIG. 1 are illustrated as needed basis. In the description herein, "upper" or "up" and "lower" or "down" imply directions on the basis of the direction of the arrow Z of the printing device 10. Similarly, "front" and "back" or "rear" imply directions on the basis of the direction of the arrow Y of the printing device 10, and "left" and "right" imply directions on the basis of the direction of the arrow X of the printing device 10.

The printing device 10 is an inkjet printer as one aspect of a liquid ejection device. The printing device 10 forms an image by ejection of ink droplets on printing paper according to externally supplied print data. The printing device 10 includes a casing 11, a paper feed slot 12, an upper surface cover 13, a paper output slot 14 and an operation unit 16. The casing 11 is an exterior member configured to receive a main unit (described later) with a printing mechanism of the printing device 10 placed therein. The paper feed slot 12 is an opening provided on a rear side of the casing 11 to be open upward. The printing paper as a printing medium is fed through the paper feed slot 12 to the main unit inside of the casing 11.

The upper surface cover 13 is a plate member located near the paper feed slot 12 and mounted on the casing 11 to be rotatable. The upper surface cover 13 serves as a guide plate to guide the printing paper into the paper feed slot 12 in the open state (illustrated state) and serves as a cover member to cover and protect the center area of the upper surface of the casing 11 in the closed state. The paper output slot 14 is an opening provided on the front surface of the casing 11. The printing paper fed through the paper feed slot 12 into the casing 11 is discharged to outside via the paper output slot 14. The operation unit 16 has buttons configured to be operable by the user and a display configured to display information to the user. The operation unit 16 is provided on the upper surface of the casing 11. The operation unit 16 is accessible by the user when the upper surface cover 13 is in the open state.

Figure 2:
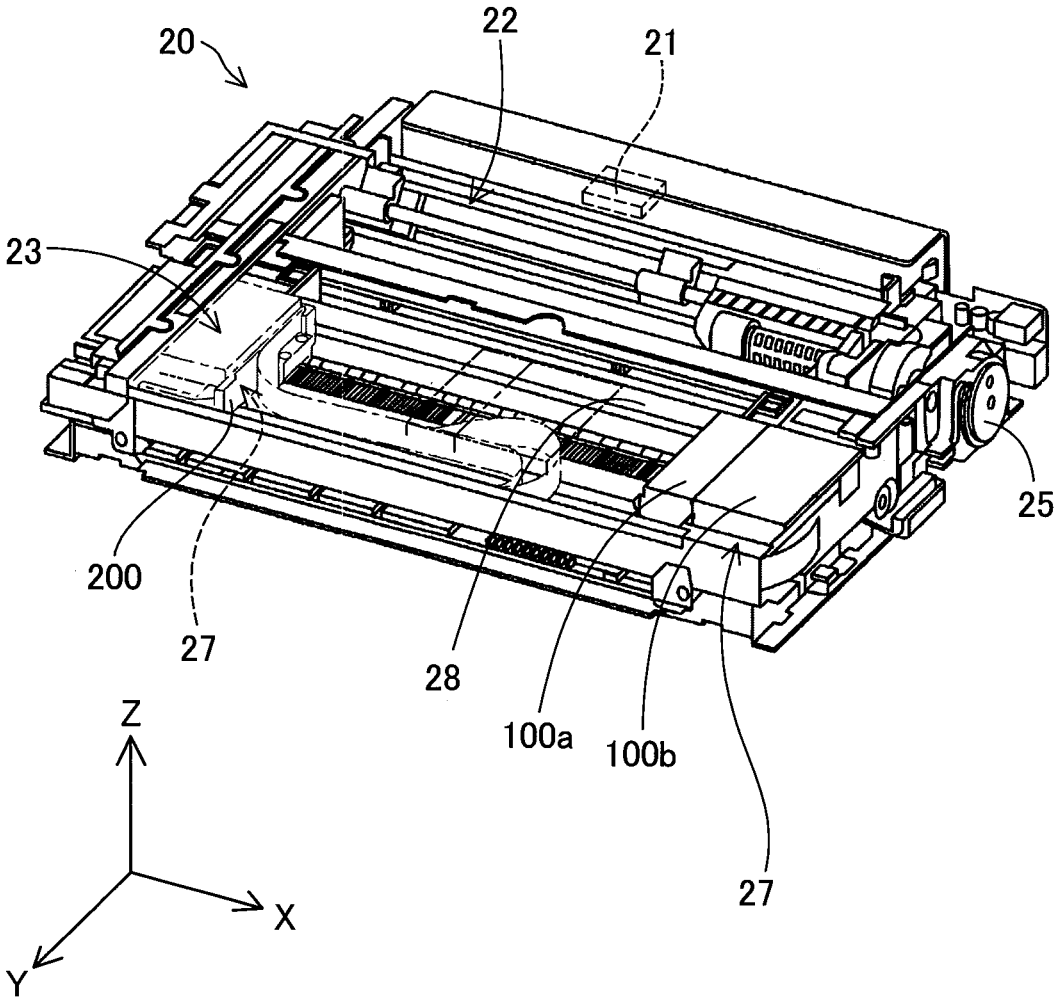
FIG. 2 is a schematic perspective view illustrating the appearance configuration of a main unit placed in a casing of the printing device.

FIG. 2 is a schematic perspective view illustrating the appearance configuration of a main unit 20 taken out of the casing 11 of the printing device 10. The locus of the move of the carriage 27 is schematically illustrated by the broken line in FIG. 2. The main unit 20 includes a controller 21, a conveyance mechanism 22 and a printing unit 23. The controller 21 is made by a microcomputer including a central processing unit and a main storage unit. The controller 21 controls the respective components of the printing device 10 in response to the user's operation of the operation unit 16 or instructions from an external computer to perform a printing operation. The conveyance mechanism 22 conveys the printing paper introduced through the paper feed slot 12 as shown in FIG. 1 to the paper output slot 14 by rotating and driving a feed roller 25 via a conveyance path (not shown) extended in the direction of the arrow Y (sub-scan direction) inside of the main unit 20.

The printing unit 23 is located on the conveyance path of the printing paper and performs printing on the printing paper conveyed by the conveyance mechanism 22. The printing unit 23 has a carriage 27 and a guide rail 28. The carriage 27 has a print head (not shown) configured to eject ink droplets. While the carriage 27 moves back and forth along the guide rail 28 extended in a main scan direction (direction of the arrow X) under control of the controller 21, the carriage 27 ejects ink droplets onto the sheet surface of the printing paper conveyed in the sub-scan direction by the conveyance mechanism 22. The printing device 10 of the embodiment is an on-carriage type and has two cartridges 100*a* and 100*b* detachably attached to the carriage 27 via a holder structure 200.

Figure 3:
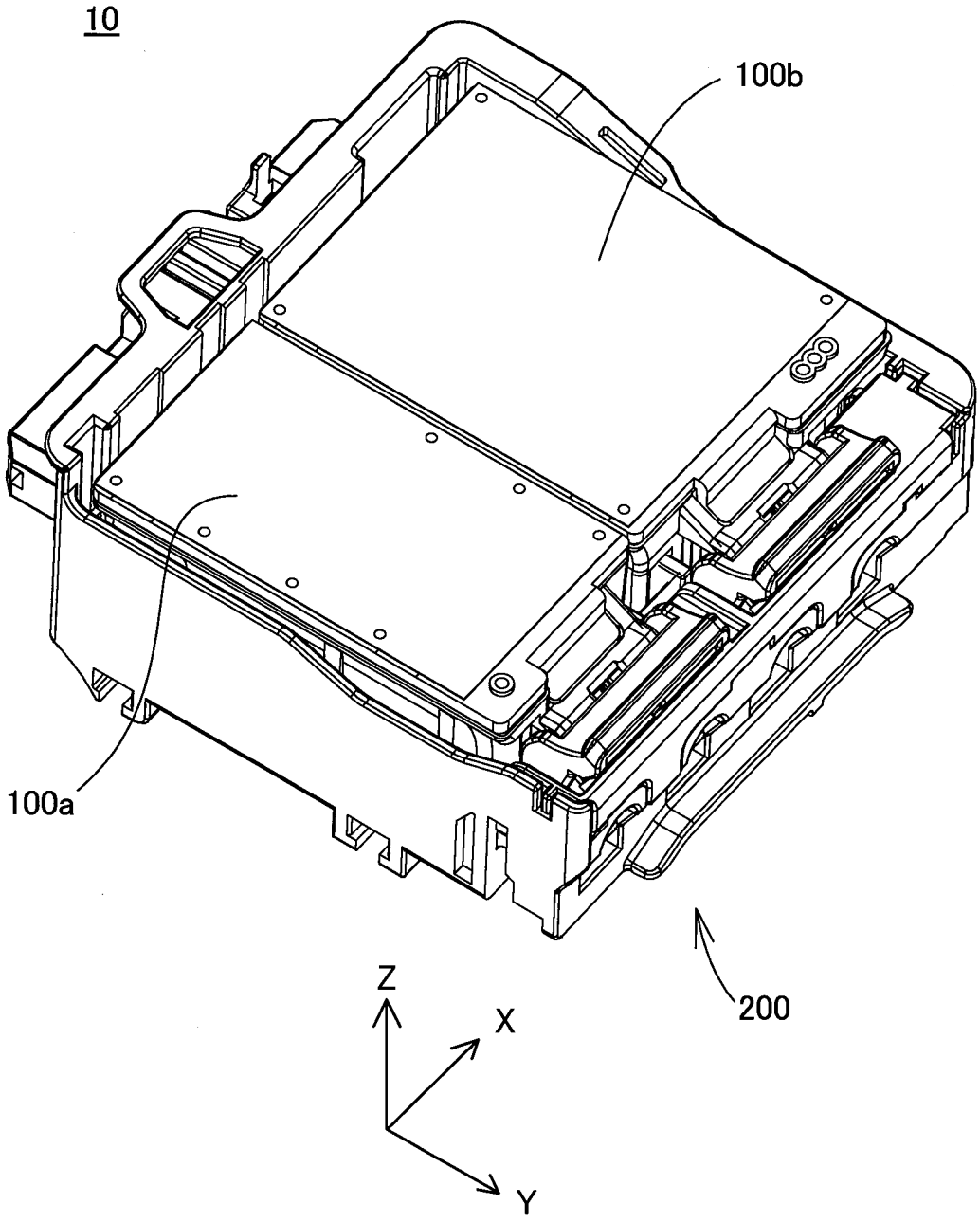
FIG. 3 is a schematic perspective view illustrating first and second cartridges attached to a holder structure.

FIG. 3 is a schematic perspective view illustrating the first cartridge 100*a* and the second cartridge 100*b* attached to the holder structure 200 in the printing device 10. The holder structure 200 corresponds to the liquid supply unit mounting mechanism and is provided as an approximately rectangular parallelepiped box-like member having an upper opening. The first and the second cartridges 100*a* and 100*b* are independently attachable to and detachable from the holder structure 200. In the state attached to the holder structure 200, the first and the second cartridges 100*a* and 100*b* have their side surfaces and bottom surfaces surrounded by walls of the holder structure 200 and their entire upper surfaces exposed upward.

The first cartridge 100*a* and the second cartridge 100*b* correspond to the liquid supply unit according to one aspect of the invention and are respectively configured to contain ink to be supplied to the printing device 10. The first cartridge 100*a* is configured to contain a single type of color ink, and the second cartridge 100*b* is configured to contain a plurality of different types of color inks. According to this embodiment, the first cartridge 100*a* contains black color ink, and the second cartridge 100*b* contains cyan, yellow and magenta color inks.

Each of the first and the second cartridges 100*a* and 100*b* is formed in an approximately rectangular parallelepiped shape. The first cartridge 100*a* has length (length in the direction of the arrow Y) and height (length in the direction of the arrow Z) substantially similar to those of the second cartridge 100*b*. The first and the second cartridges 100*a* and 100*b* are placed in parallel in the holder structure 200 in the state that their lengths and heights are substantially the same.

The following sequentially describes the detailed configuration of the holder structure 200, the detailed configurations of the first and the second cartridges 100*a* and 100*b*, and the mechanism of attachment and fixation of the first and the second cartridges 100*a* and 100*b* to the holder structure 200. The directions of the arrows X, Y and Z shown in the drawings illustrating the configuration of the holder structure 200 correspond to the directions in the printing device 10. The directions of the arrows X, Y and Z shown in the drawings illustrating the first and the second cartridges 100*a* and 100*b* denote the directions in the state attached to the printing device 10 described above.

[Configuration of Holder Structure]

Figure 4:
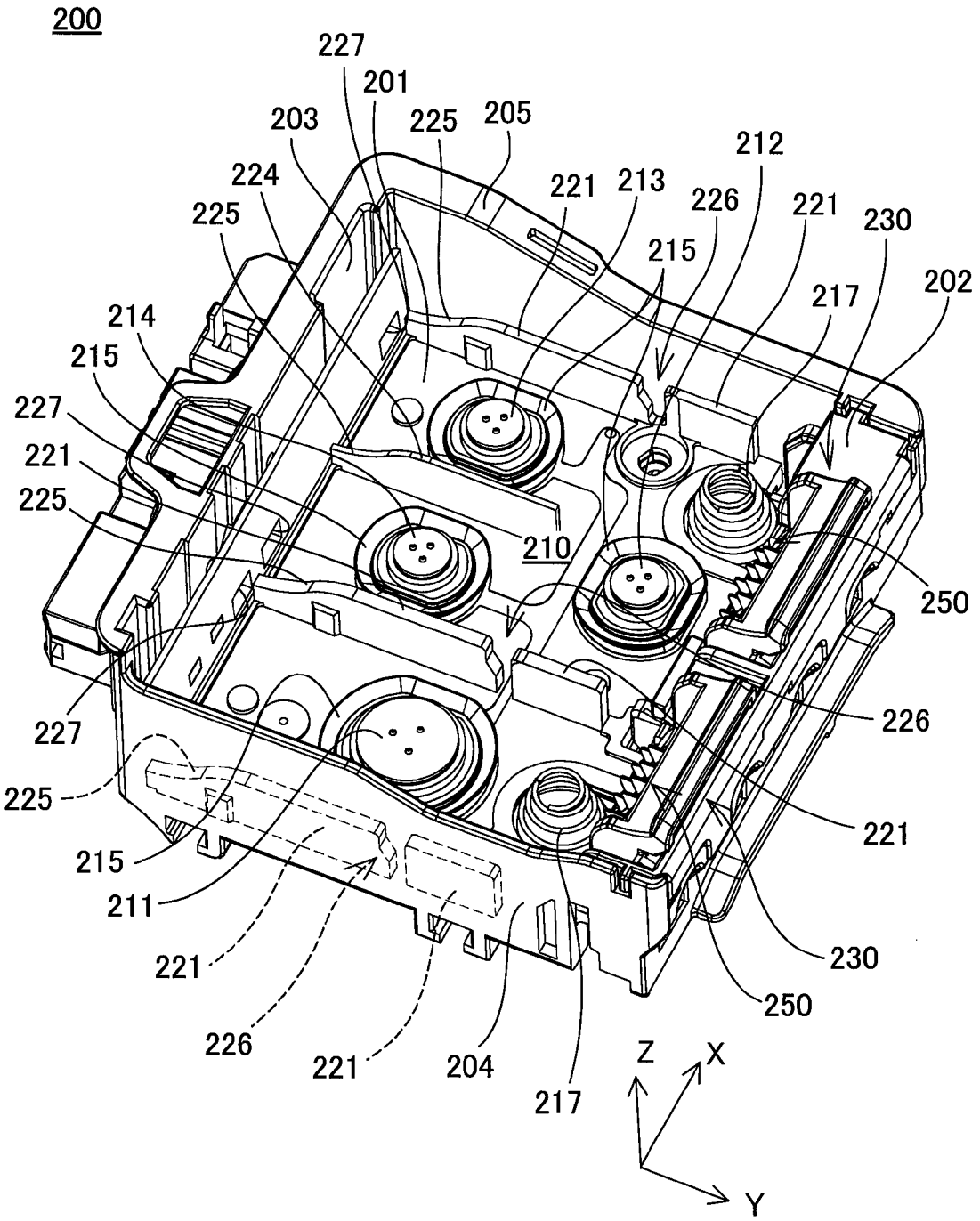
FIG. 4 is a perspective top view illustrating the holder structure from a front side.
Figure 5:
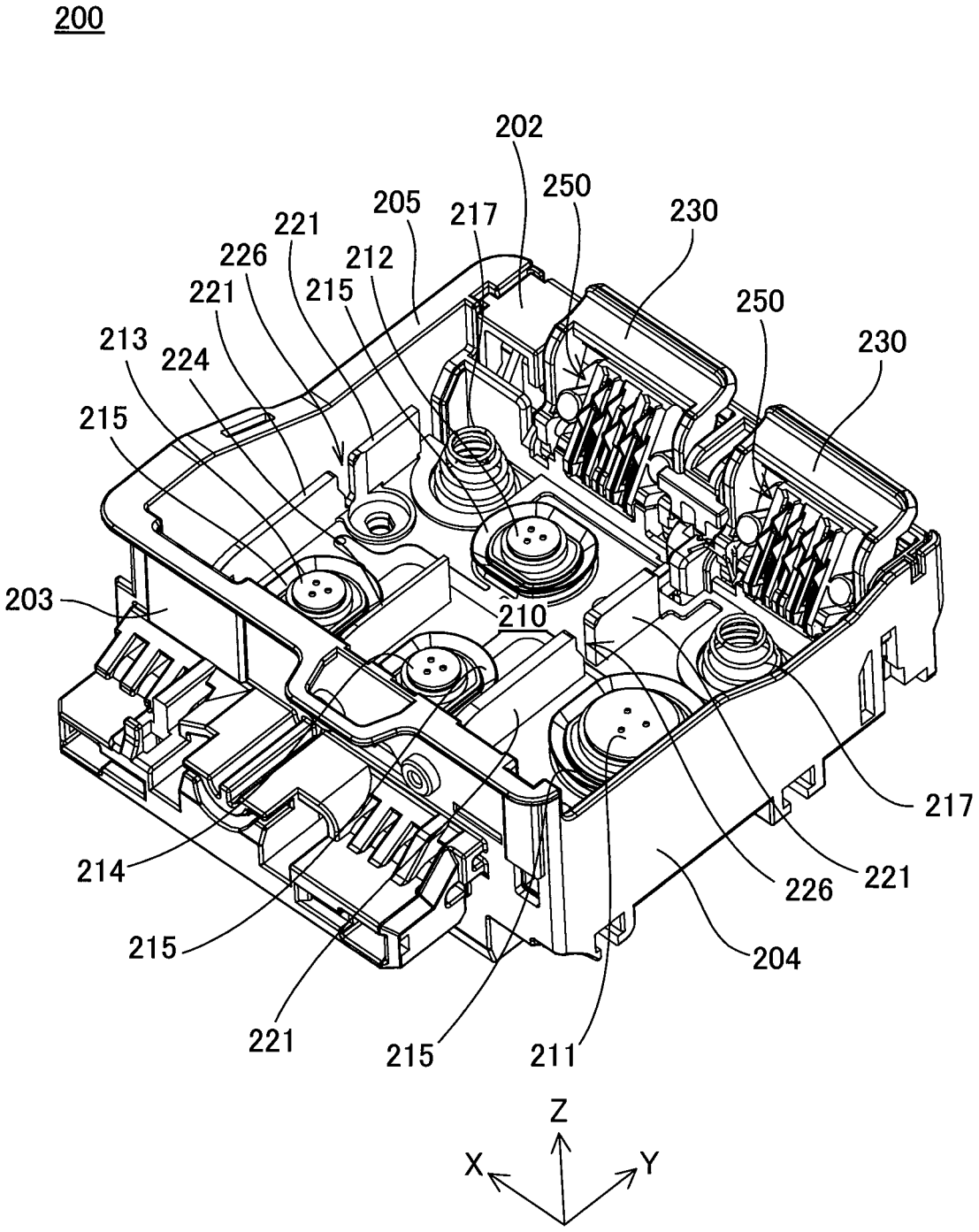
FIG. 5 is a perspective top view illustrating the holder structure from a rear side.
Figure 6:
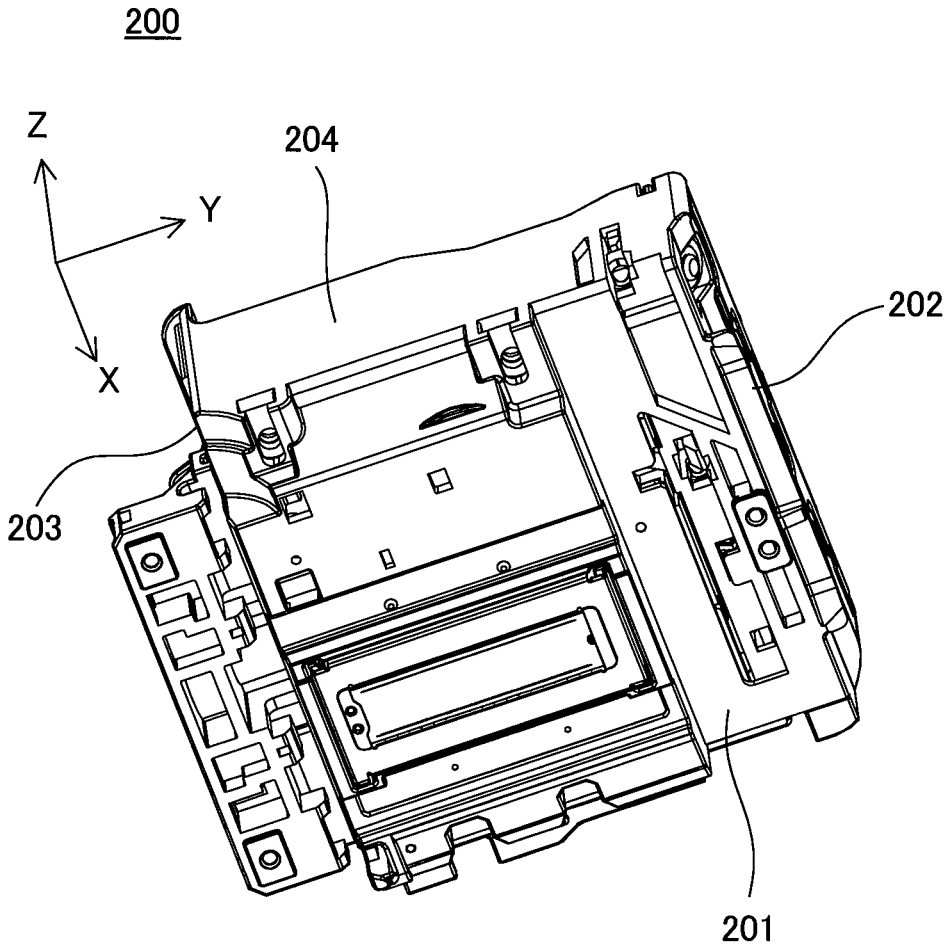
FIG. 6 is a perspective bottom view illustrating the holder structure.

The general configuration of the holder structure 200 is described with reference to FIGS. 4 to 6. FIG. 4 is a perspective top view illustrating the holder structure 200 from the front side. FIG. 5 is a perspective top view illustrating the holder structure 200 from the rear side. FIG. 6 is a perspective bottom view illustrating the holder structure 200. The holder structure 200 is formed as the approximately rectangular parallelepiped box-like member having the upper opening as described above. The holder structure 200 has a cartridge chamber 210 to receive the first and the second cartridges 100*a* and 100*b* placed therein and five walls 201 to 205 arranged to surround the cartridge chamber 210.

The bottom wall 201 forms a bottom surface of the cartridge chamber 210 on which the first and the second cartridges 100*a* and 100*b* are placed. The front wall 202 and the rear wall 203 are respectively extended substantially vertically upward from a front-side end and a rear-side end of the bottom wall 201 to form a front surface and a rear surface of the cartridge chamber 210. The first side wall 204 and the second side wall 205 are respectively extended substantially vertically upward from a left-side end and a right-side end of the bottom wall 201 to form a left side surface and a right side surface of the cartridge chamber 210.

The bottom wall 201 has ink receiving parts 211 to 214 as shown in FIGS. 4 and 5. The ink receiving parts 211 to 214 correspond to the liquid introducing parts and are configured to be connected with ink supply ports (described later) of the respective cartridges 100*a* and 100*b* and receive supplies of inks through the ink supply ports. A seal member 215 is provided on the outer periphery of each of the ink receiving parts 211 to 214. The seal member 215 suppresses invasion of the air to the ink flow path, as well as leakage of ink to outside.

The bottom wall 201 has pressing mechanisms 217 configured to press upward the respective cartridges 100*a* and 100*b* placed thereon. According to this embodiment, the pressing mechanisms 217 are made by helical springs. Each of the pressing mechanisms 217 is located at a position adjacent to a lever member 230. Pressing by the pressing mechanisms 217 enhances the engagement force between the lever members 230 and main engagement parts (described later) of the respective cartridges 100*a* and 100*b*. In the course of detachment of the first or the second cartridge 100*a* or 100*b* from the holder structure 200, the pressing mechanism 217 presses upward the first or the second cartridge 100*a* or 100*b*, so as to enhance the operability of detachment.

The bottom wall 201 also has first sub-wall members 221 and a second sub-wall member 224 which are arranged parallel to the first side wall 204 and the second side wall 205 and have lower heights. The first sub-wall members 221 are provided at the positions adjacent to the first side wall 204 and the second side wall 205 and at the position of a boundary between areas where the first and the second cartridges 100*a* and 100*b* are placed. The second sub-wall member 224 is provided at the position of a boundary between second and third ink chambers (described later) in the area where the second cartridge 100*b* is placed.

The first sub-wall member 221 has a sloped section 225 formed on its rear end to have the height gradually decreasing backward. The first sub-wall member 221 also has a cut 226 in the middle of the cartridge chamber 210 in the direction of the arrow Y. The sloped sections 225 and the cuts 226 work as guides to guide the motions of the first and the second cartridges 100*a* and 100*b* (described later in detail) in the course of attachment of the first and the second cartridges 100*a* and 100*b* to the holder structure 200.

The second sub-wall member 224 has a sloped section 225 formed on its rear end, like the first sub-wall member 221. The sloped section 225 of the second sub-wall member 224 also works as a guide to guide the motion of the second cartridge 100*b* in the course of attachment of the second cartridge 100*b* to the holder structure 200. The second sub-wall member 224 is fit in a groove (described later) formed in a lower wall of the second cartridge 100*b*, so as to fix the second cartridge 100*b*. Fixation members are provided on a lower surface of the bottom wall 201 as shown in FIG. 6 to fix the holder structure 200 to the carriage 27, although not being described in detail herein.

A plurality of fitting holes 227 are provided at a lower edge of the cartridge chamber 210-side wall surface of the rear wall 203 as shown in FIG. 4 to be arrayed in the direction of the arrow X. In the course of attachment of the first or the second cartridge 100*a* or 100*b*, a plurality of projections (described later) provided at a lower edge of a rear wall of each of the cartridges 100*a* and 100*b* are inserted and fit in the fitting holes 227.

The front wall 202 as shown in FIG. 5 has the two lever members 230 provided adjacent to each other to respectively correspond to the first and the second cartridges 100*a* and 100*b*. The two lever members 230 have similar structures. Each of the lever members 230 is a rotation mechanism rotated and driven in the course of attachment or detachment of the first or the second cartridge 100*a* or 100*b*.

Each of the lever members 230 serves as an engagement member configured to engage with each of the first and the second cartridges 100*a* and 100*b* and accordingly stop the first or the second cartridge 100*a* or 100*b* (described later in detail). The term "engaging" herein means engaging with a specified region of an object to limit the moving of the object. The term "stopping" herein means stopping the object in the engaged state. Device-side terminal assemblies 250 of a similar structure are respectively placed below the levers 230. Each of the device-side terminal assemblies 250 corresponds to the electrode assembly configured to be in electrically contact with a circuit substrate (described later) of each of the cartridges 100*a* and 100*b*.

Figure 7:
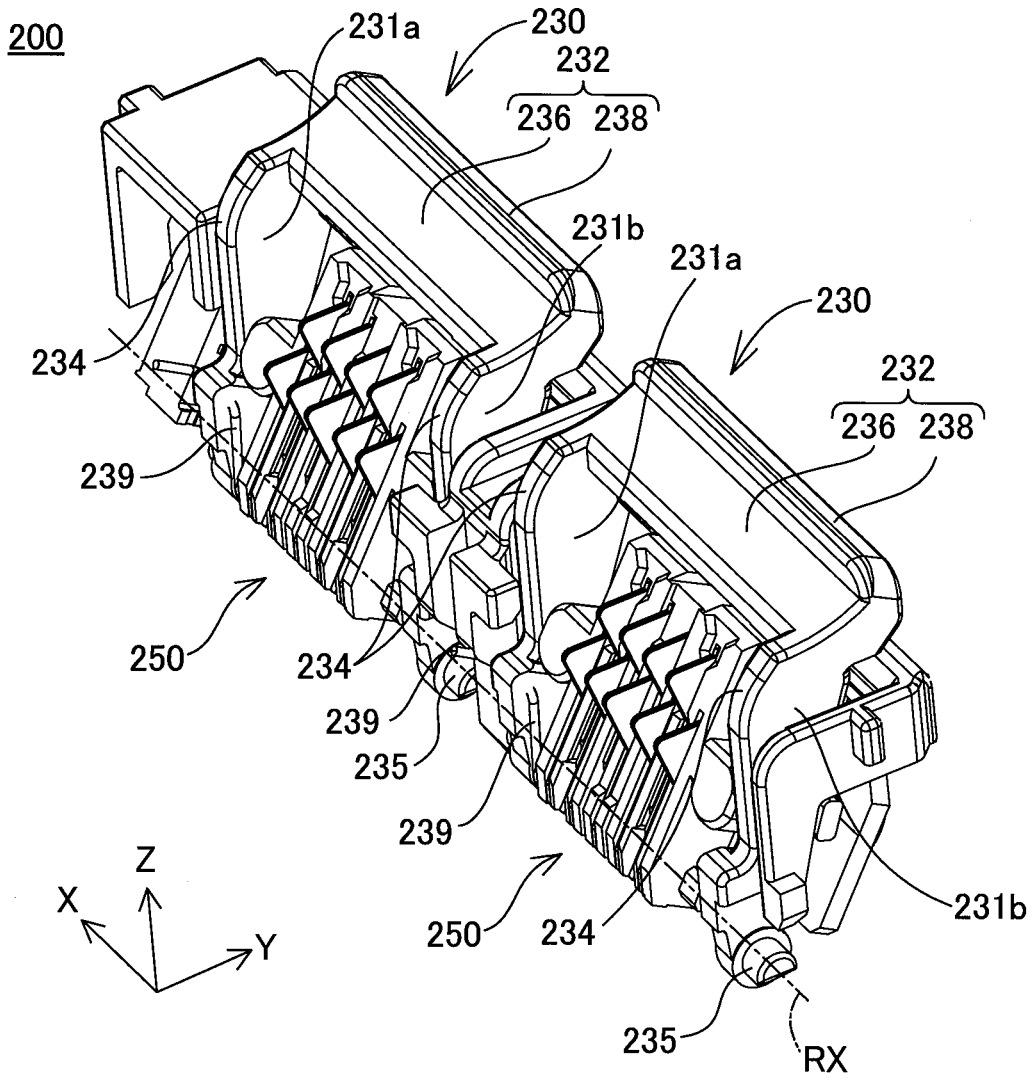
FIG. 7 is a perspective top view illustrating lever members and device-side terminal assemblies in a state attached to the holder structure.
Figure 8:
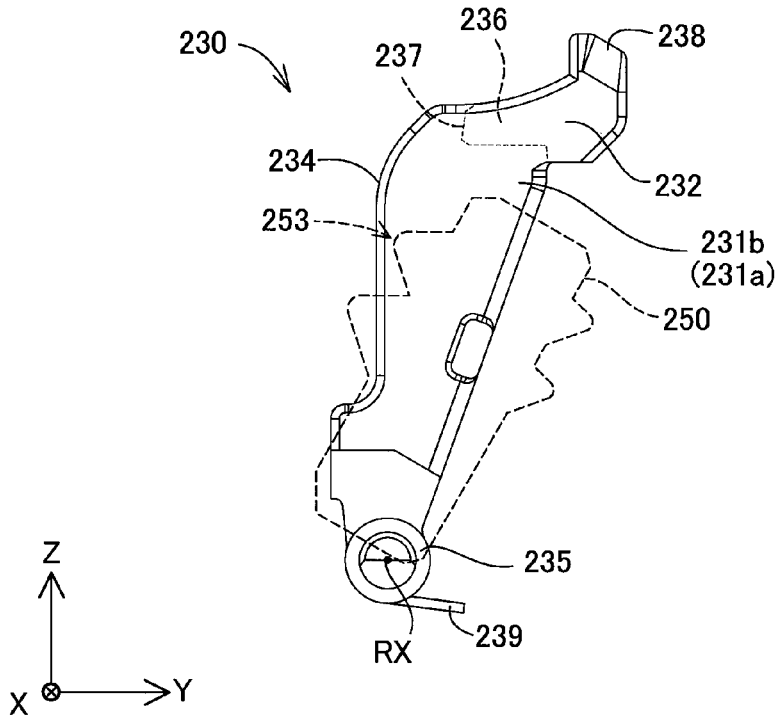
FIG. 8 is a side view illustrating the lever member.

The following sequentially describes the detailed structures of the lever member 230 and the device-side terminal assembly 250 with reference to FIGS. 7 to 11. FIG. 7 is a perspective top view illustrating the periphery of the lever members 230 and the device-side terminal assemblies 250 in the state attached to the front wall 202 of the holder structure 200. FIG. 8 is a side view illustrating the lever member 230. A rotation axis RX of the lever member 230 is illustrated in FIGS. 7 and 8. An area where the device-side terminal assembly 250 is placed in the holder structure 200 is illustrated by the broken line in FIG. 8.

The lever member 230 has first and second leg sections 231*a* and 231*b* extended in the direction of the arrow Z and a bridging section 232 arranged to bridge upper edges of the first and the second leg sections 231*a* and 231*b*. The lever member 230 is formed bilaterally symmetrical and has the first and the second leg sections 231*a* and 231*b* of substantially similar structures. The respective leg sections 231*a* and

231*b* are made by flat plates and are arranged to be parallel to a plane defined by the directions of the arrows Y and Z.

Each of the leg sections 231*a* and 231*b* has the width in the direction of the arrow Y expanding upward and has an extension section 234 formed by extending its outer peripheral end in an upper area near the bridging section 232 toward the cartridge chamber 210 as shown in FIG. 5. In the initial state that the respective cartridges 100*a* and 100*b* are not attached to the holder structure 200, the extension sections 234 have their outer peripheral ends located at positions closer to the cartridge chamber 210 than an upper-line terminal group 253 (described later) of the device-side terminal assembly 250. The extension sections 234 are also extended upward (direction of the arrow Z) which is the direction of attachment of each of the cartridges 100*a* and 100*b*. The presence of the extension sections 234 suppresses the user's fingertip or any portion of each cartridge 100*a* or 100*b* other than the terminals from coming into contact with the upper-line terminal group 253 and accordingly protects the upper-line terminal group 253.

Each of the leg sections 231*a* and 231*b* has a convex 235 provided at its lower edge to be protruded outward in the direction of the arrow X. The convexes 235 respectively correspond to the first rotating shaft member and the second rotating shaft member. The respective convexes 235 are fit in recesses (not shown in Figures) formed in the front wall 202, so that the lever member 230 is attached to be rotatable in the front-back direction about center axes of the respective convexes 235 as the rotation axis RX. Providing the supporting points of rotation at the respective leg sections 231*a* and 231*b* stabilizes the rotating operation of the lever member 230.

Each of the leg sections 231*a* and 231*b* also has a pressing mechanism 239 as a pressing member at its lower edge. According to this embodiment, the pressing mechanism 239 is made by a torsion spring. The lever member 230 is stopped to rest at a predefined rotating angle in the state pressed toward the cartridge chamber 210 by the pressing mechanism 239. The lever member 230 is rotated and moved when an external force is applied, and is returned to its initial position by the pressing force of the pressing mechanism 239 when the external force is released. Providing the pressing mechanisms 239 corresponding to the respective leg sections 231*a* and 231*b* achieves downsizing while ensuring the pressing force, compared with the configuration of providing the pressing mechanism at only one of the leg sections.

The bridging section 232 of the lever member 230 has a flat plate part 236 and an operating part 238. The flat plate part 236 is a flat plate-like portion located on the side of the cartridge chamber 210 as shown in FIG. 5 and extended in the direction of the arrow Y. In the state that the first and the second cartridges 100*a* and 100*b* are attached to the holder structure 200, the lower surface of the flat plate part 236 comes into contact with a main engagement part (described later) of each of the cartridges 100*a* and 100*b* to limit the upward motion of the cartridge 100*a* or 100*b*. The flat plate part 236 corresponds to the abutting part. In the course of attachment of each of the first and the second cartridges 100*a* and 100*b*, a rear end face 237 of the flat plate part 236 is pressed by the cartridge 100*a* or 100*b* to receive an external force working as the drive force of rotating and driving the lever member 230. Detailed description of this mechanism is described later.

The operating part 238 is located on the front (direction of the arrow Y) side of the flat plate part 236 and is bent upward from the flat plate part 236. The user places a finger on the operating part 238 and pulls the operating part 238, so as to rotate and move the lever member 230 forward. According to this embodiment, the operating part 238 is formed over the entire length between the first and the second leg sections 231*a* and 231*b*, so as to enhance the user's accessibility.

The device-side terminal assembly 250 is placed between the first and the second leg sections 231*a* and 231*b* of the lever member 230 as shown in FIG. 7. The device-side terminal assembly 250 is in a plate-like shape and is fixed to the front wall 202 of the holder structure 200 independently of the lever member 230 to have an angle of inclination corresponding to the angle of inclination of a circuit substrate (described later) of each of the first and the second cartridges 100*a* and 100*b*.

Figure 9:
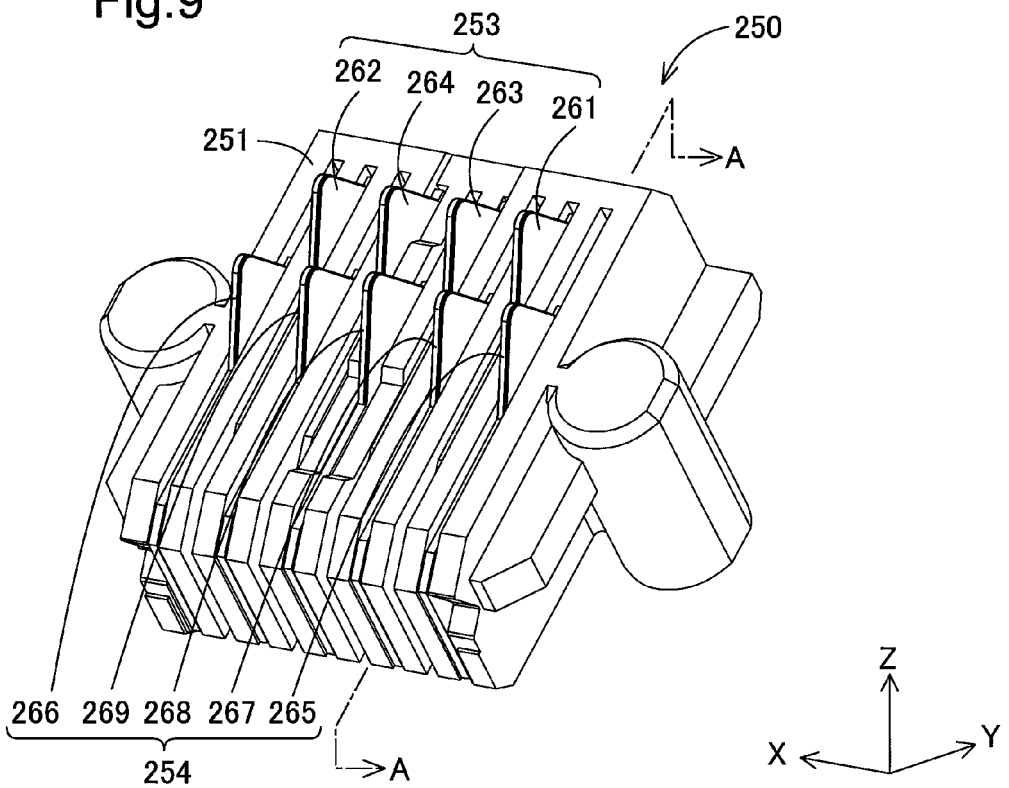
FIG. 9 is a schematic perspective view illustrating a rear surface of the device-side terminal assembly.
Figure 10:
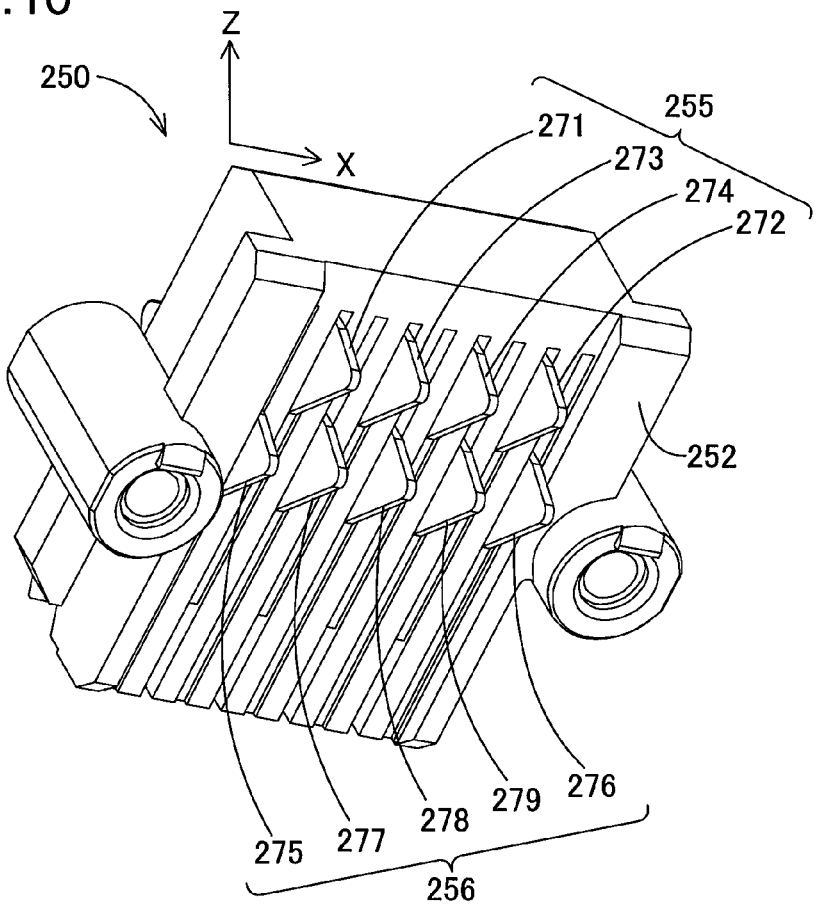
FIG. 10 is a schematic perspective view illustrating a front surface of the device-side terminal assembly.
Figure 11:
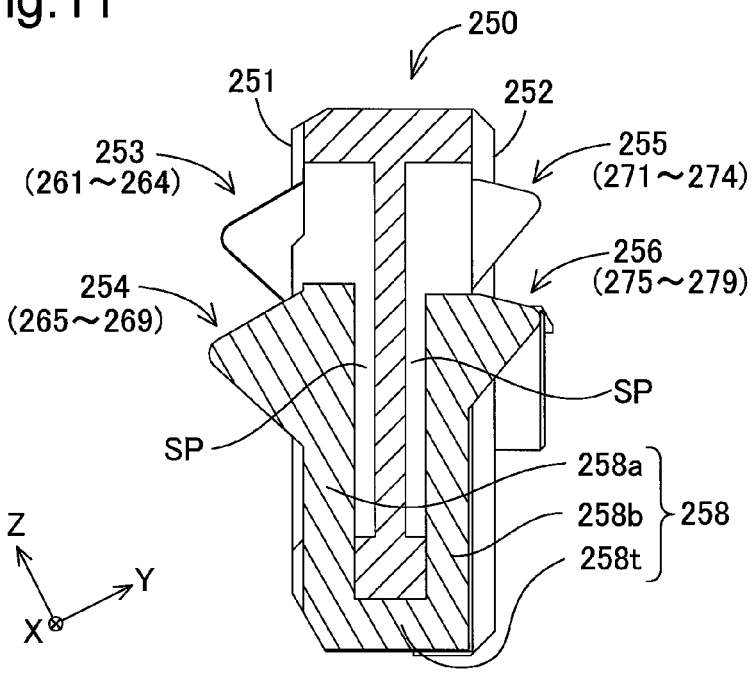
FIG. 11 is a schematic cross sectional view illustrating the device-side terminal assembly.

FIG. 9 is a schematic perspective view illustrating a rear side surface of the device-side terminal assembly 250. FIG. 10 is a schematic perspective view illustrating a front side surface of the device-side terminal assembly 250. FIG. 11 is a schematic cross sectional view illustrating the device-side terminal assembly 250, taken on a line A-A in FIG. 9. The device-side terminal assembly 250 has a rear side (cartridge chamber 210-side) surface 251 and a front side surface 252. In the description below, the rear side surface 251 is called "terminal assembly surface 251", and the front side surface 252 is called "terminal assembly rear face 252".

The terminal assembly surface 251 as shown in FIG. 9 has an upper-line terminal group 253 and a lower-line terminal group 254. The upper-line terminal group 253 includes a plurality of terminals 261 to 264 arrayed in the direction of the arrow X. The lower-line terminal group 254 is located below the upper-line terminal group 253 and includes a plurality of terminals 265 to 269 arrayed in the direction of the arrow X. The respective terminals 261 to 269 on the terminal assembly surface 251 are directly in contact with corresponding terminals of the circuit substrate (described later) of each of the cartridges 100*a* and 100*b*, when the cartridge 100*a* or 100*b* is attached to the holder structure 200.

The first terminal 261 and the second terminal 262 are placed on respective ends in the direction of the arrow X of the upper-line terminal group 253. The third terminal 263 and the fourth terminal 264 are aligned in the direction of the arrow X between the first and the second terminals 261 and 262. The fifth terminal 265 and the sixth terminal 266 are placed on respective ends in the direction of the arrow X of the lower-line terminal group 254. The seventh terminal 267, the eighth terminal 268 and the ninth terminal 260 are aligned in the direction of the arrow X between the fifth and the sixth terminals 265 and 266.

According to this embodiment, each of the terminals 261 to 269 is made by an approximately triangular metal plate protruded from the terminal assembly surface 251. The respective terminals 261 to 269 are arranged in parallel such that their thickness direction is the direction of the arrow X. The respective apexes of the terminals 261 to 269 come into contact with the terminals of each of the cartridges 100*a* and 100*b*. This enhances the pressing force of the respective terminals 261 to 269 applied to the circuit substrate of each cartridge 100*a* or 100*b*, thus improving the electrical connectivity.

The first terminal 261 and the second terminal 262 are used by the printing device 10 to detect attachment of each of the cartridges 100*a* and 100*b* to the holder structure 200 (described later in detail). The first and the second terminals 261 and 262 are placed on the respective ends in the direction of the arrow X which have the less number of adjacent terminals. This configuration suppresses the occurrence of a short circuit with another terminal. The first and the second terminals 261 and 262 are protected by the extension sections 234 of the first and the second leg sections 231*a* and 231*b* of the lever member 230. This configuration suppresses the occurrence of a contact failure with a terminal on the cartridge 100*a* or 100*b*. Additionally, the first terminal 261 and the second terminal 262 are arranged to be away from each other in the direction of the arrow X. This configuration suppresses misdetection of attachment of the circuit substrate of each of the cartridges 100*a* and 100*b* inclined relative to the direction of the arrow X as the correct attachment state. This enhances the detection accuracy of the attachment state of each of the cartridges 100*a* and 100*b* in the holder structure 200 of the embodiment.

The third terminal 263 is a ground terminal and corresponds to a low potential terminal configured to supply a low potential to a storage unit (described later) of each of the cartridges 100*a* and 100*b*. The fourth terminal 264 is a power terminal and corresponds to a high potential terminal configured to supply a high potential to the storage unit of each of the cartridges 100*a* and 100*b*. Like the first and the second terminals 261 and 262, the fifth and the sixth terminals 265 and 266 are used by the printing device 10 to detect attachment of each of the cartridges 100*a* and 100*b* to the holder structure 200. In an application that each of the cartridges 100*a* and 100*b* has a sensor for detecting the remaining quantity of ink, the fifth and the sixth terminals 265 and 266 may serve as sensor driving terminals to supply electric power to the sensor.

The seventh terminal 267 is a reset terminal configured to supply a reset signal to the storage unit of each of the cartridges 100*a* and 100*b*. The eighth terminal 268 is a clock terminal configured to supply a clock signal from the printing device 10 to the storage unit of each of the cartridges 100*a* and 100*b*. The ninth terminal 269 is a data terminal configured to send and receive a data signal to and from the storage unit of each of the cartridges 100*a* and 100*b*. The printing device 10 sends and receives data to and from the storage unit of each of the cartridges 100*a* and 100*b* by serial transfer via the ninth terminal 269, in response to the clock signal supplied via the eighth terminal 268.

The terminal assembly rear face 252 as shown in FIG. 10 also has an upper-line terminal group 255 and a lower-line terminal group 256, like the terminal assembly surface 251. The upper-line terminal group 255 includes a plurality of terminals 271 to 274 arrayed in the direction of the arrow X. The lower-line terminal group 256 is located below the upper-line terminal group 255 and includes a plurality of terminals 275 to 279 arrayed in the direction of the arrow X. Each of the terminals 271 to 279 on the terminal assembly rear face 252 is made by a triangular metal plate, like the respective terminals 261 to 269 on the terminal assembly surface 251. The respective terminals 271 to 279 on the terminal assembly rear face 252 are electrically connected with a circuit structure including the controller 21 of the printing device 10.

The first terminal 271 and the second terminal 272 are placed on respective ends in the direction of the arrow X of the upper-line terminal group 255 to be electrically connected with the first and the second terminals 261 and 262 on the terminal assembly surface 251. The third terminal 273 and the fourth terminal 274 are aligned in the direction of the arrow X between the first and the second terminals 271 and 272. The fifth terminal 275 and the sixth terminal 276 are placed on respective ends in the direction of the arrow X of the lower-line terminal group 256. The seventh terminal 277, the eighth terminal 278 and the ninth terminal 279 are aligned in the direction of the arrow X between the fifth and the sixth terminals 275 and 276.

Each of the terminals 261 to 269 on the terminal assembly surface 251 as shown in FIG. 9 is connected with a corresponding one of the terminals 271 to 279 at the corresponding position on the terminal assembly rear face 252 as shown in FIG. 10 via a conductive element 258 as shown in FIG. 11. The conductive element 258 is made by a plate-like metal member. The conductive element 258 has two extension areas 258*a* and 258*b* and a folded area 258*t*. The two extension areas 258*a* and 258*b* are extended downward from each of the terminals 261 to 269 on the terminal assembly surface 251 or from each of the terminals 271 to 279 on the terminal assembly rear face 252. The two extension areas 258*a* and 258*b* are folded and linked with each other in the folded area 258*t* at the lower end of the device-side terminal assembly 250.

The conductive element 258 is held by the device-side terminal assembly 250 via its folded area 258*t* at the lower end. Spaces SP are formed respectively below the extension area 258*a* on the terminal assembly surface 251 and below the extension area 258*b* on the terminal assembly rear face 252. This configuration causes the conductive element 258 to work as a leaf spring having elastic force in the thickness direction of the device-side terminal assembly 250. Each of the terminals 261 to 269 and 271 to 279 is pressed by the conductive element 258 along the direction of its projection (thickness direction of the device-side terminal assembly 250). Such pressing enables each of the terminals 261 to 269 and 271 to 279 of the device-side terminal assembly 250 to be in better contact with the corresponding terminal of each of the cartridges 100*a* and 100*b* and enhances the electrical connectivity.

Figure 13:
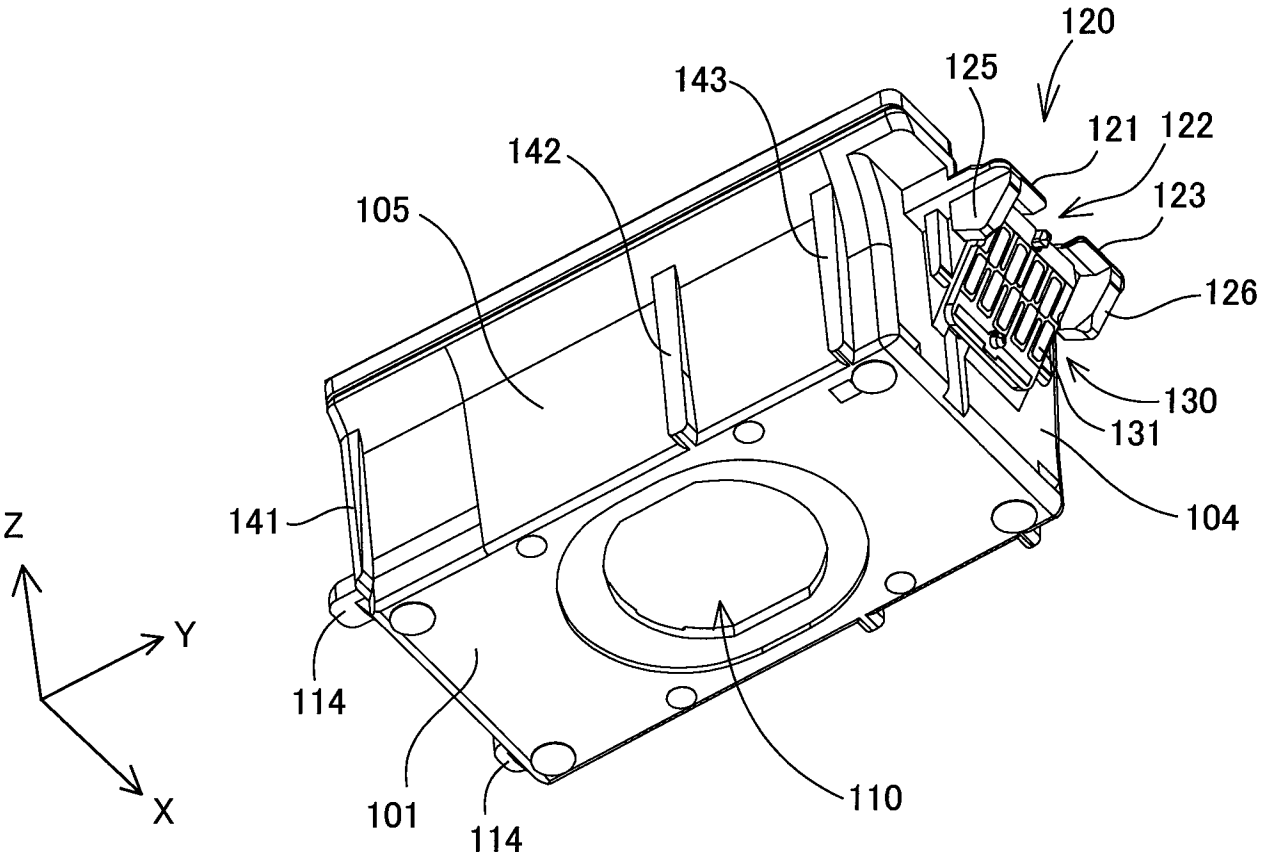
FIG. 13 is a perspective bottom view illustrating the first cartridge.
Figure 19:
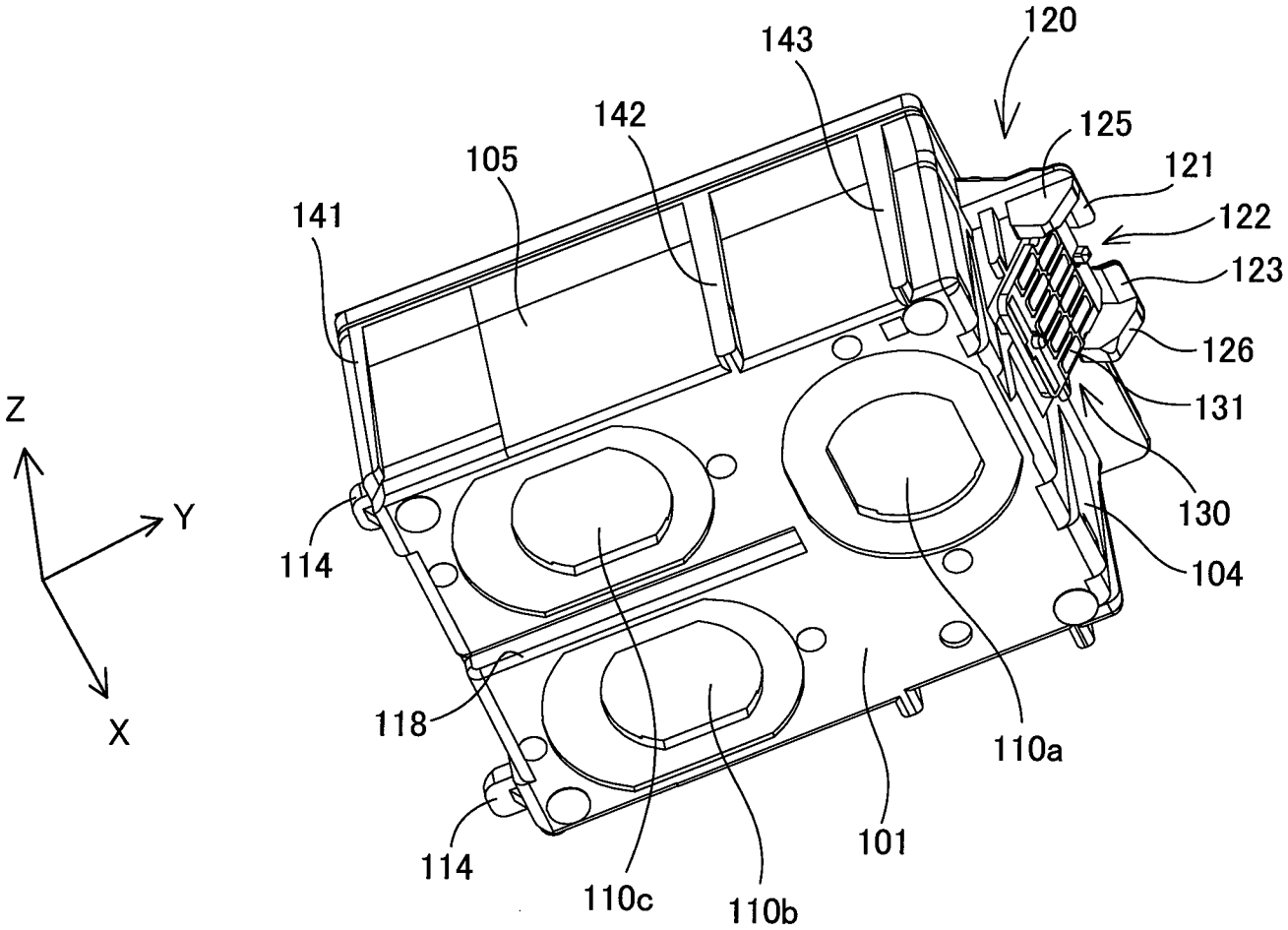
FIG. 19 is a perspective bottom view illustrating the second cartridge.

The folding structure of the conductive elements 258 at the lower end of the device-side terminal assembly 250 enables the respective terminals 261 to 269 and 271 to 279 to be located relatively on the upper side of the device-side terminal assembly 250, while ensuring the pressing force of the conductive elements 258. Locating the respective terminals 261 to 269 and 271 to 279 on the upper side of the device-side terminal assembly 250 causes the position of contact with a circuit substrate 130 as shown in FIGS. 13 and 19 of each of the cartridges 100*a* and 100*b* to be made close to the engagement position of the lever member 230 with the main engagement part 120. This enhances the electrical connectivity between the device-side terminal assembly 250 and the circuit substrate 130. This configuration also enables the circuit substrate 130 of each of the cartridges 100*a* and 100*b* to be located at a position away from the lower end of each cartridge 100*a* or 100*b* and additionally enables the circuit substrate 130 to be located at a position close to the main engagement part 120. This configuration enhances the protection of the circuit substrate 130 of each of the cartridges 100*a* and 100*b*.

[Structure of First Cartridge]

Figure 12:
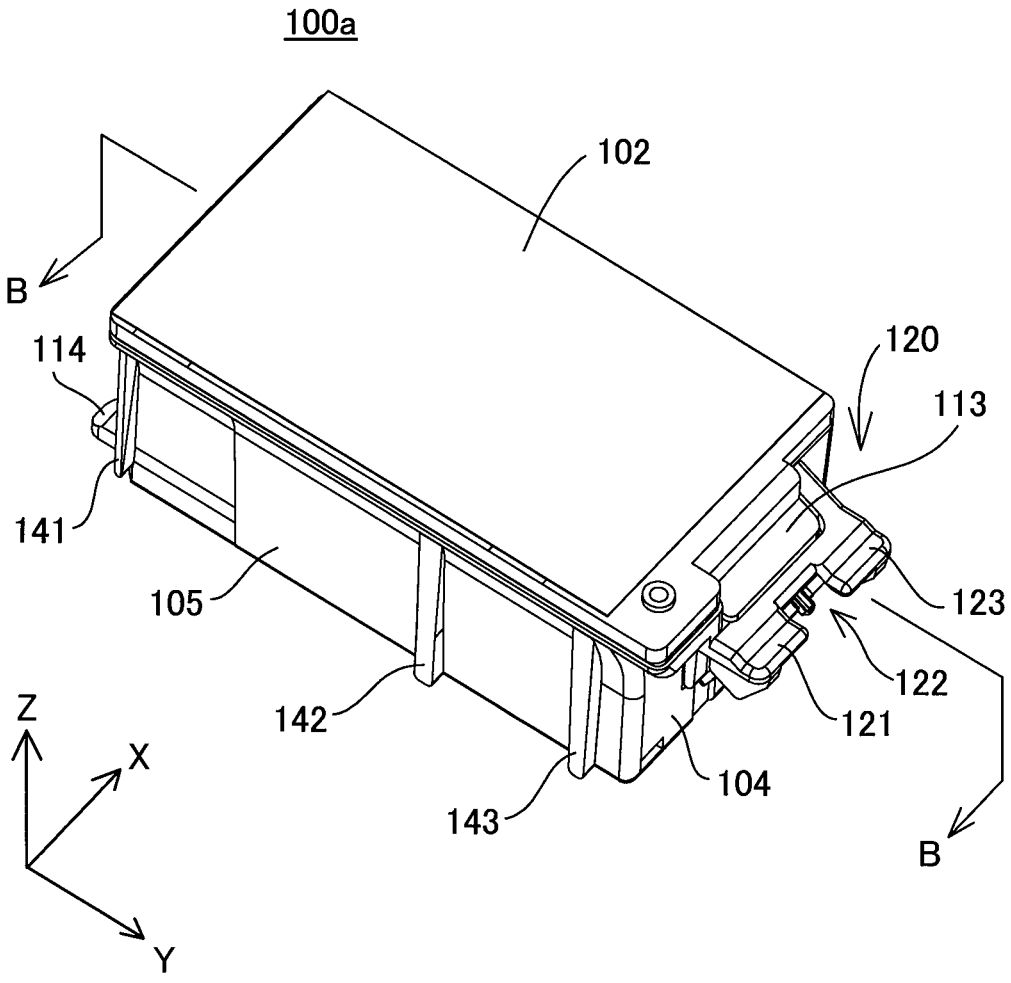
FIG. 12 is a perspective top view illustrating the first cartridge.
Figure 14:
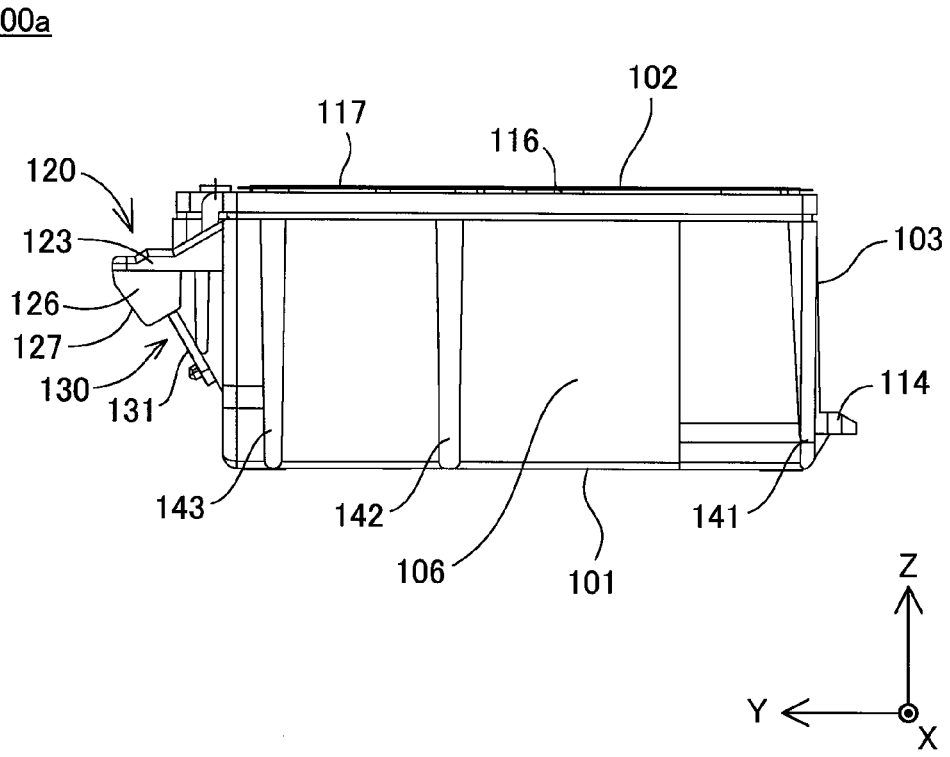
FIG. 14 is a side view illustrating the first cartridge.
Figure 15:
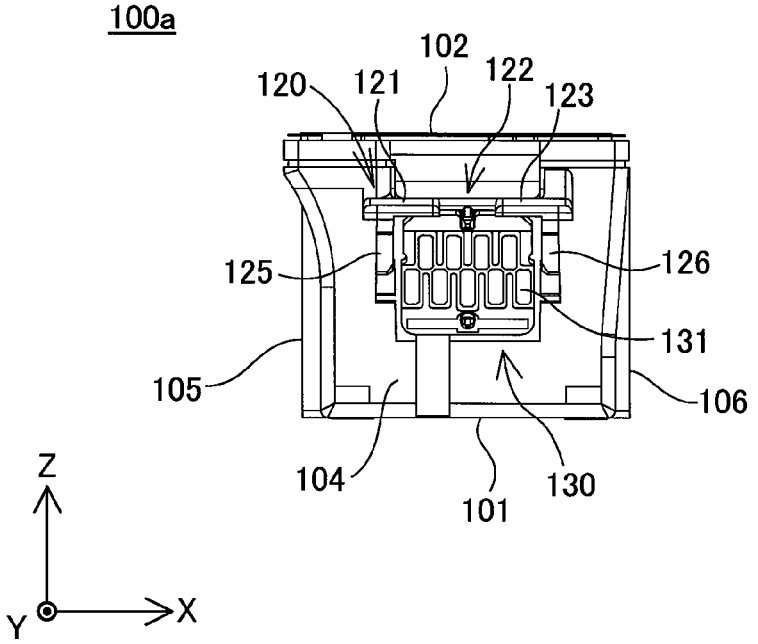
FIG. 15 is a front view illustrating the first cartridge.
Figure 16:
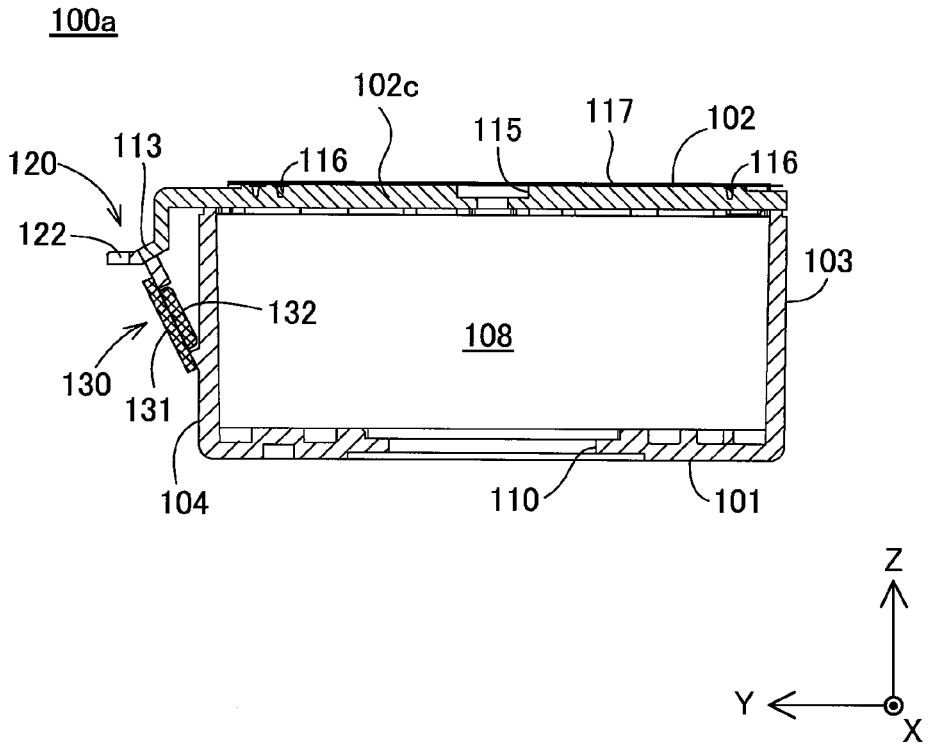
FIG. 16 is a schematic cross sectional view illustrating the first cartridge.

The detailed structure of the first cartridge 100*a* is described with reference to FIGS. 12 to 16. FIG. 12 is a perspective top view illustrating the first cartridge 100*a*. FIG. 13 is a perspective bottom view illustrating the first cartridge 100*a*. FIG. 14 is a side view illustrating the first cartridge 100*a*. FIG. 15 is a front view illustrating the first cartridge 100*a*. FIG. 16 is a schematic cross sectional view illustrating the first cartridge 100*a*, taken on a line B-B in FIG. 12. The detailed internal structure of an ink chamber 108 is omitted from the illustration of FIG. 16.

The first cartridge 100*a* has six walls 101 to 106 constituting an exterior assembly surrounding an ink chamber 108 as shown in FIG. 16 configured to contain ink. The first wall 101 as shown in FIG. 13 forms a bottom surface of the first cartridge 100*a*. The bottom surface denotes a surface facing in a direction opposite to the direction of the arrow Z in the state of attachment of the first cartridge 100*a* to the printing device 10 and also denotes a surface opposed to the bottom wall 201 of the holder structure 200 in the state of attachment of the first cartridge 100*a* to the holder structure 200. An ink supply port 110 communicating with the ink chamber 108 is provided on the center of the first wall 101. The ink supply port 110 corresponds to the liquid supply port and is connected with the ink receiving part 211 of the holder structure 200 in the state of attachment of the first cartridge 100*a* to the holder structure 200.

The second wall 102 as shown in FIG. 12 is opposed to the first wall 101 and forms a top surface of the first cartridge 100*a*. The top surface denotes a surface facing in the direction of the arrow Z in the state of attachment of the first cartridge 100*a* to the printing device 10. The second wall 102 is formed by a cover member 102*c* as shown in FIG. 16 configured to be separable from the main body of the first cartridge 100*a*. The second wall 102 has a through hole 115 through which the ink chamber 108 is refilled with ink, an air flow groove 116 arranged to introduce the outside air into the ink chamber 108 and a film-like seal member 117 placed to seal the through hole 115 and the air flow groove 116. The second wall 102 has an extended section 113 located on the center of an edge adjacent to the fourth wall 104 to be extended in the direction of the arrow Y. In the description herein, the term "extending" means continuously extending without intermission. The extended section 113 forms part of the main engagement part 120.

The third wall 103 as shown in FIG. 14 is arranged to intersect with the first wall 101 and the second wall 102. The third wall 103 forms a rear surface of the first cartridge 100*a* and is arranged to face backward of the printing device 10 (direction opposite to the direction of the arrow Y) in the state of attachment of the first cartridge 100*a* to the holder structure 200. The third wall 103 has a plurality of projections 114 at its lower end to be protruded in the direction opposite to the direction of the arrow Y. The plurality of projections 114 are placed at both ends in the direction of the arrow X. The plurality of projections 114 are inserted in and engaged with the fitting holes 227 as shown in FIG. 4 formed in the rear wall 203 of the holder structure 200 in the course of attachment of the first cartridge 100*a* to the holder structure 200.

The fourth wall 104 is arranged to intersect with the first wall 101 and the second wall 102 and to be opposed to the third wall 103 as shown in FIGS. 12 to 16. The fourth wall 104 forms a front surface of the first cartridge 100*a* and is arranged to face forward of the printing device 10 (direction of the arrow Y) and face the user in the state of attachment of the first cartridge 100*a* to the holder structure 200. The fourth wall 104 has the main engagement part 120 which is to be engaged with the lever member 230 of the holder structure 200. The main engagement part 120 is arranged on the fourth wall 104 to have its upper edge located closer to the second wall 102 than the first wall 101 and to be on the approximate center in the direction of the arrow X.

The main engagement part 120 is formed as a tongue-shaped brim extended forward and slightly downward from the second wall 102. The main engagement part 120 has a cut 122 on the center of its front edge as a local recess, such that the front edge of the main engagement part 120 is divided into two separate parts by the recessed space of the cut 122. In other words, the front edge of the main engagement part 120 is configured to have a first brim section 121 as a first section, the cut 122, a second brim section 123 as a second section arranged sequentially in the direction of the arrow X. The first brim section 121 and the second brim section 123 have respective upper surfaces to come into surface contact with the lower surface of the flat plate part 236 of the lever member 230 as shown in FIG. 8 in the course of engagement with the lever member 230 of the holder structure 200.

A first side wall portion 125 and a second side wall portion 126 are provided on the respective lower surfaces of the first brim section 121 and the second brim section 123 to be protruded and suspended downward in parallel to each other. The first side wall portion 125 and the second side wall portion 126 respectively press and rotate the lever member 230 of the holder structure 200 in the course of attachment of the first cartridge 100*a* to the holder structure 200. Detailed description of a rotation mechanism of the lever member 230 is described later. The first side wall portion 125 and the second side wall portion 126 also serve as protective elements of the circuit substrate 130 as described later.

The circuit substrate 130 is placed below the main engagement part 120 on the fourth wall 104 to transmit electrical signals to and from the printing device 10 as shown in FIG. 13. The circuit substrate 130 is fixed to the fourth wall 104 to face its surface down at an inclination angle of, for example, 10 to 45 degrees relative to the direction of the arrow Z.

The circuit substrate 130 includes a terminal part 131 and a storage unit 132 as shown in FIG. 16. The terminal part 131 has a plurality of terminals which come into contact with and are electrically connected with the respective terminals 261 to 269 of the device-side terminal assembly 250 of the holder structure 200 as shown in FIG. 9. The array configuration of the plurality of terminals included in the terminal part 131 of the circuit substrate 130 will be described later. The storage unit 132 is made by, for example, a rewritable nonvolatile memory, such as flash ROM. The storage unit 132 stores information regarding ink, for example, the color and the remaining quantity of ink contained in the first cartridge 100*a* in non-transitory manner.

According to this embodiment, the circuit substrate 130 is located between the first side wall portion 125 and the second side wall portion 126 of the main engagement part 120 as shown in FIGS. 13 and 15. The first side wall portion 125 and the second side wall portion 126 are protruded forward from the surface of the circuit substrate 130 on both sides of the circuit substrate 130. This configuration suppresses the user from accidentally touching the terminals on the circuit substrate 130 and thereby protects the respective terminals of the terminal part 131.

The fifth wall 105 and the sixth wall 106 are arranged to intersect with the first wall 101, the second wall 102, the third wall 103 and the fourth wall 104 and to be opposed to each other as shown in FIGS. 12 to 15. The fifth wall 105 and the sixth wall 106 form side surfaces of the first cartridge 100*a*. Each of the fifth wall 105 and the sixth wall 106 has ribs 141, 142 and 143 on its surface to be extended in the direction of the arrow Z.

The first rib 141 is provided on a rear end of the side surface, the second rib 142 is provided at a middle position in the front-back direction of the side surface, and the third rib 143 is provided on a front end of the side surface. The respective ribs 141, 142 and 143 work as reinforcing elements for the side wall surfaces of the first cartridge 100*a*. In the course of attachment of the first cartridge 100*a* to the holder structure 200, the ribs 141, 142 and 143 serve as guide elements to define the moving direction of the first cartridge 100*a* and as positioning elements to fix the position of the first cartridge 100*a*. Detailed description of these functions of the ribs 141, 142 and 143 is described later.

Figure 17:
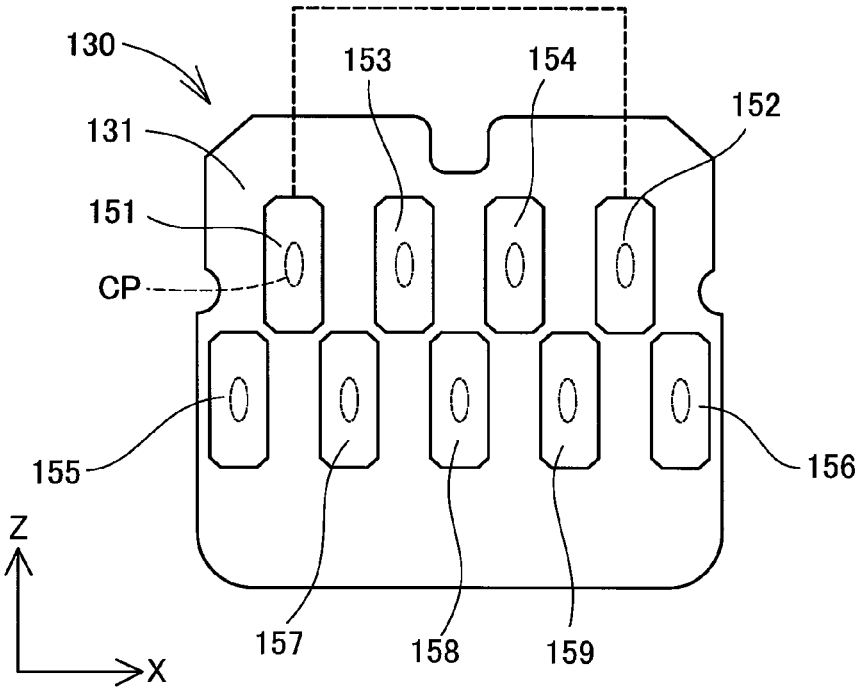
FIG. 17 is a schematic diagram illustrating an array configuration of a plurality of terminals on a circuit substrate.

FIG. 17 is a schematic diagram illustrating an array configuration of a plurality of terminals 151 to 159 on the circuit substrate 130. The positions of contacts CP of the respective terminals 151 to 159 are shown by broken lines in FIG. 17. Each of the plurality of terminals 151 to 159 has a contact CP. Each of the contacts CP of the respective terminals 151 to 159 comes into contact with and is electrically connected with corresponding one of the terminals 261 to 269 provided on the device-side terminal assembly 250 of the holder structure 200 as shown in FIG. 9. The contacts CP of the respective terminals 151 to 159 are arrayed in two lines, an upper line and a lower line, to be connectable with the respective terminals 261 to 269 of the device-side terminal assembly 250 of the holder structure 200 and are arranged in an array direction parallel to the direction of the arrow X. The contacts CP of the first and the second terminals 151 and 152 are located on the respective ends in the upper line. The contacts CP of the third and the fourth terminals 153 and 154 are aligned in the direction of the arrow X between the first terminal 151 and the second terminal 152. The contacts CP of the fifth and the sixth terminals 155 and 156 are located on the respective ends in the lower line. The contacts CP of the seventh, the eighth and the ninth terminals 157, 158 and 159 are aligned in the direction of the arrow X between the fifth terminal 155 and the sixth terminal 156.

The first terminal 151 and the second terminal 152 are configured to have a specified voltage change when the first cartridge 100*a* is adequately attached to the holder structure 200 to bring the first terminal 151 and the second terminal 152 into contact with the corresponding first terminal 261 and second terminal 262 of the device-side terminal assembly 250. More specifically, the first terminal 151 and the second terminal 152 are short-circuited inside of the circuit substrate 130. The printing device 10 applies a predetermined voltage to the first terminal 151 of the circuit substrate 130 via the first terminal 261 of the device-side terminal assembly 250 and detects a voltage change at the second terminal 152 of the circuit substrate 130 via the second terminal 262 of the device-side terminal assembly 250. The other terminals 153 to 159 have similar functions to those of the corresponding terminals 263 to 269 of the device-side terminal assembly 250 described above.

[Structure of Second Cartridge]

Figure 18:
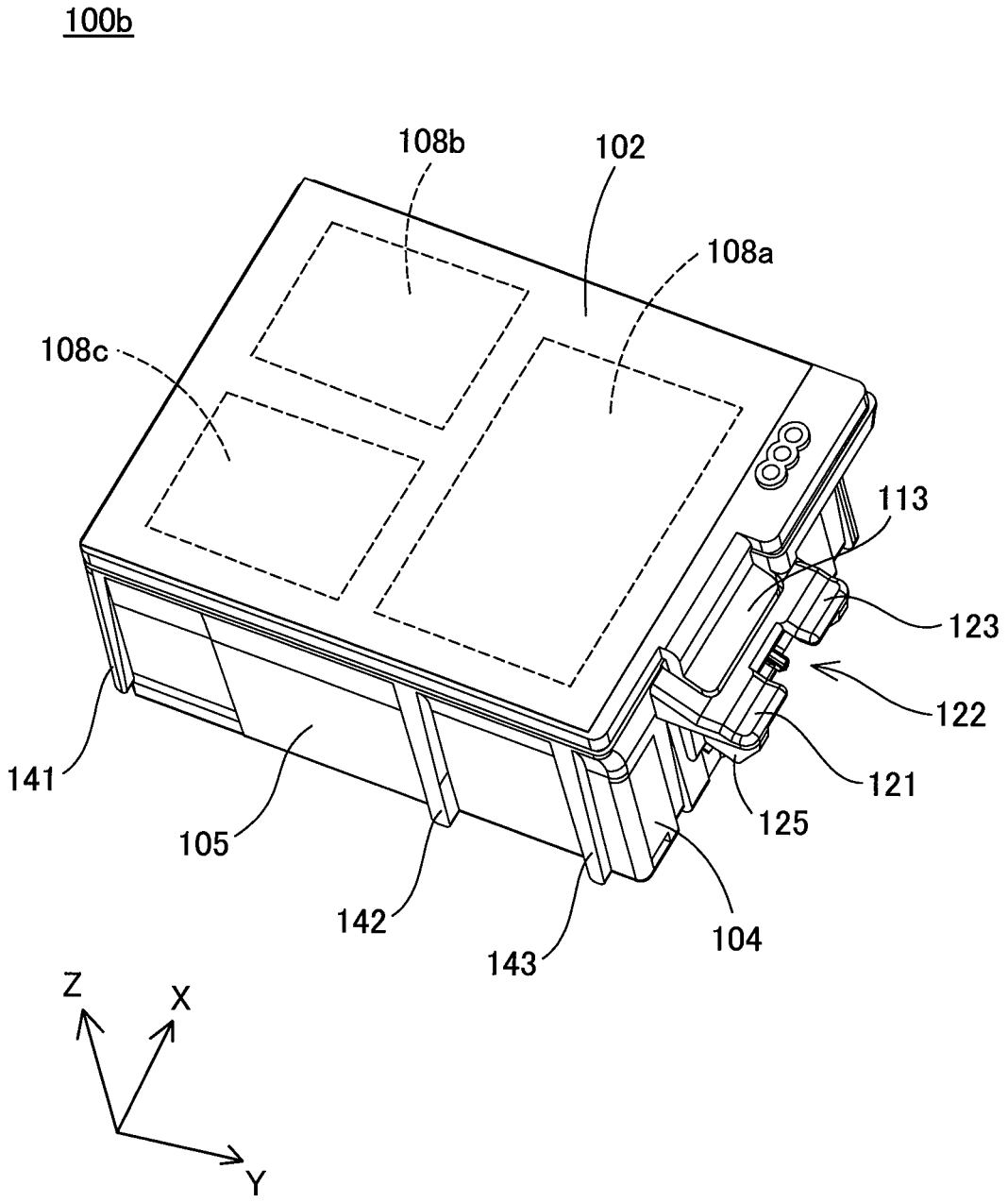
FIG. 18 is a perspective top view illustrating the second cartridge.
Figure 20:
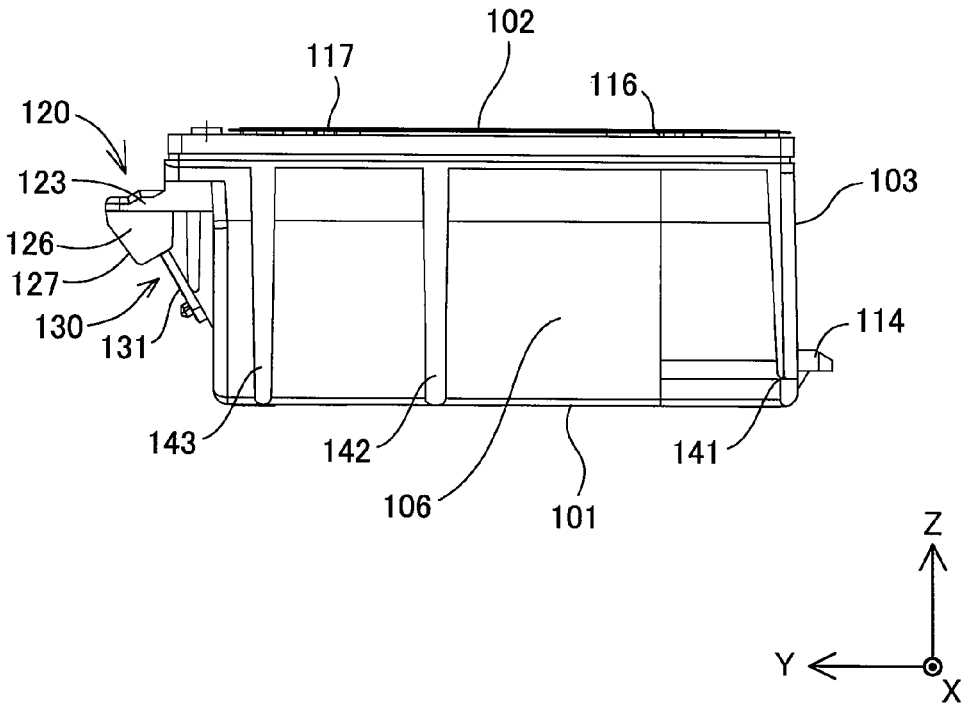
FIG. 20 is a side view illustrating the second cartridge.
Figure 21:
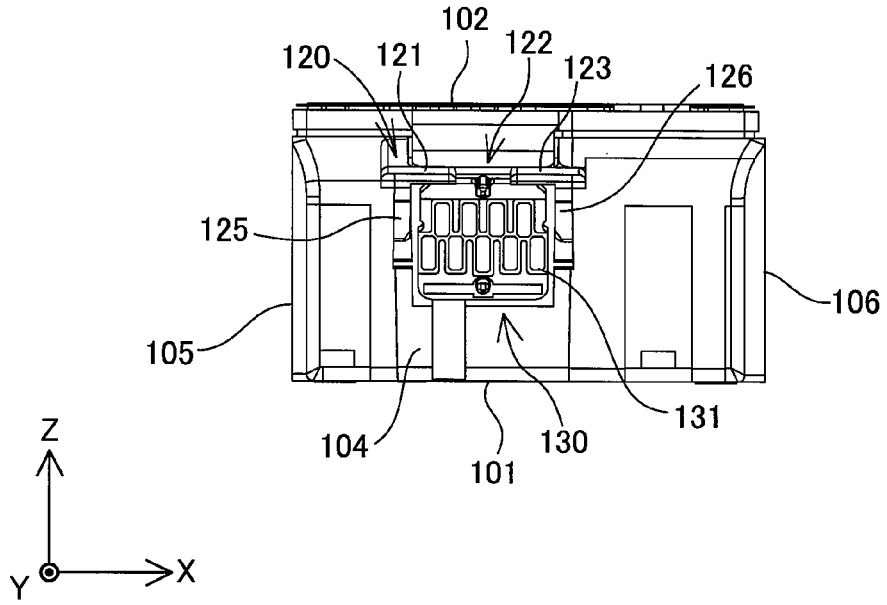
FIG. 21 is a front view illustrating the second cartridge.

The detailed structure of the second cartridge 100*b* is described with reference to FIGS. 18 to 21. FIG. 18 is a perspective top view illustrating the second cartridge 100*b*. As a matter of convenience, ink chambers 108*a* to 108*c* formed inside of the second cartridge 100*b* are illustrated by the broken line in FIG. 18. FIG. 19 is a perspective bottom view illustrating the second cartridge 100*b*. FIG. 20 is a side view illustrating the second cartridge 100*b*. FIG. 21 is a front view illustrating the second cartridge 100*b*. In FIGS. 18 to 21, the like components to those of the first cartridge 100*a* described above with reference to FIGS. 12 to 16 are expressed by the like numerical symbols.

The second cartridge 100*b* has sixth walls 101 to 106 respectively corresponding to the walls 101 to 106 of the first cartridge 100*a*. The inside of the second cartridge 100*b* is parted into three ink chambers 108*a* to 108*c* configured to separately contain three different color inks. The first ink chamber 108*a* is formed in a front area facing the fourth wall 104. The second and the third ink chambers 108*b* and 108*c* are formed by dividing an area behind the first ink chamber 108*a* into two parts in the direction of the arrow X. The second ink chamber 108*b* is formed on the side facing the fifth wall 105, and the third ink chamber 108*c* is formed on the side facing the sixth wall 106.

The first wall 101 as shown in FIG. 19 has three ink supply ports 110*a* to 110*c* formed corresponding to the respective ink chambers 108*a* to 108*c*. The first ink supply port 110*a* is formed to have its center at a position substantially aligned with the center in the direction of the arrow X of the main engagement part 120 provided on the fourth wall 104. The second ink supply port 110*b* and the third ink supply port 110*c* are formed on the respective centers of the second ink chamber 108*b* and the third ink chamber 108*c*. A groove 118 extended linearly in the direction of the arrow Y is formed between the second and the third ink supply ports 110*b* and 110*c* at a position corresponding to the boundary between the second and the third ink chambers 108*b* and 108*c*. The groove 118 engages with the second sub-wall member 224 of the holder structure 200 as shown in FIG. 4 fit therein when the second cartridge 100*b* is attached to the holder structure 200.

The second wall 102 as shown in FIG. 18 has substantially similar structure to that of the second wall 102 of the first cartridge 100*a*, except a different width in the direction of the arrow X and a different location where an extended section 113 is formed. In the second cartridge 100*b*, the extended section 113 is formed at a position shifted from the center in the direction opposite to the direction of the arrow X at the edge adjacent to the fourth wall 104. The third wall 103 as shown in FIG. 20 has substantially similar structure to that of the third wall 103 of the first cartridge 100*a*, except a different width in the direction of the arrow X.

The fourth wall 104 as shown in FIGS. 18 to 21 has substantially similar structure to that of the fourth wall 104 of the first cartridge 100*a*, except a different location where a main engagement part 120 is formed. In the second cartridge 100*b*, the main engagement part 120 is formed at a position shifted from the center in the direction opposite to the direction of the arrow X at the edge adjacent to the second wall 102. This configuration causes the respective main engagement parts 120 to be arranged adjacent to and close to each other when the first and the second cartridges 100*a* and 100*b* are attached to the holder structure 200 as shown in FIG. 3. The fifth wall 105 as shown in FIGS. 18 and 19 and the sixth wall 106 as shown in FIG. 21 respectively have substantially similar structures to those of the fifth wall 105 and the sixth wall 106 of the first cartridge 100*a*.

[Mounting Mechanism of Cartridge to Holder Structure]

Figure 22:
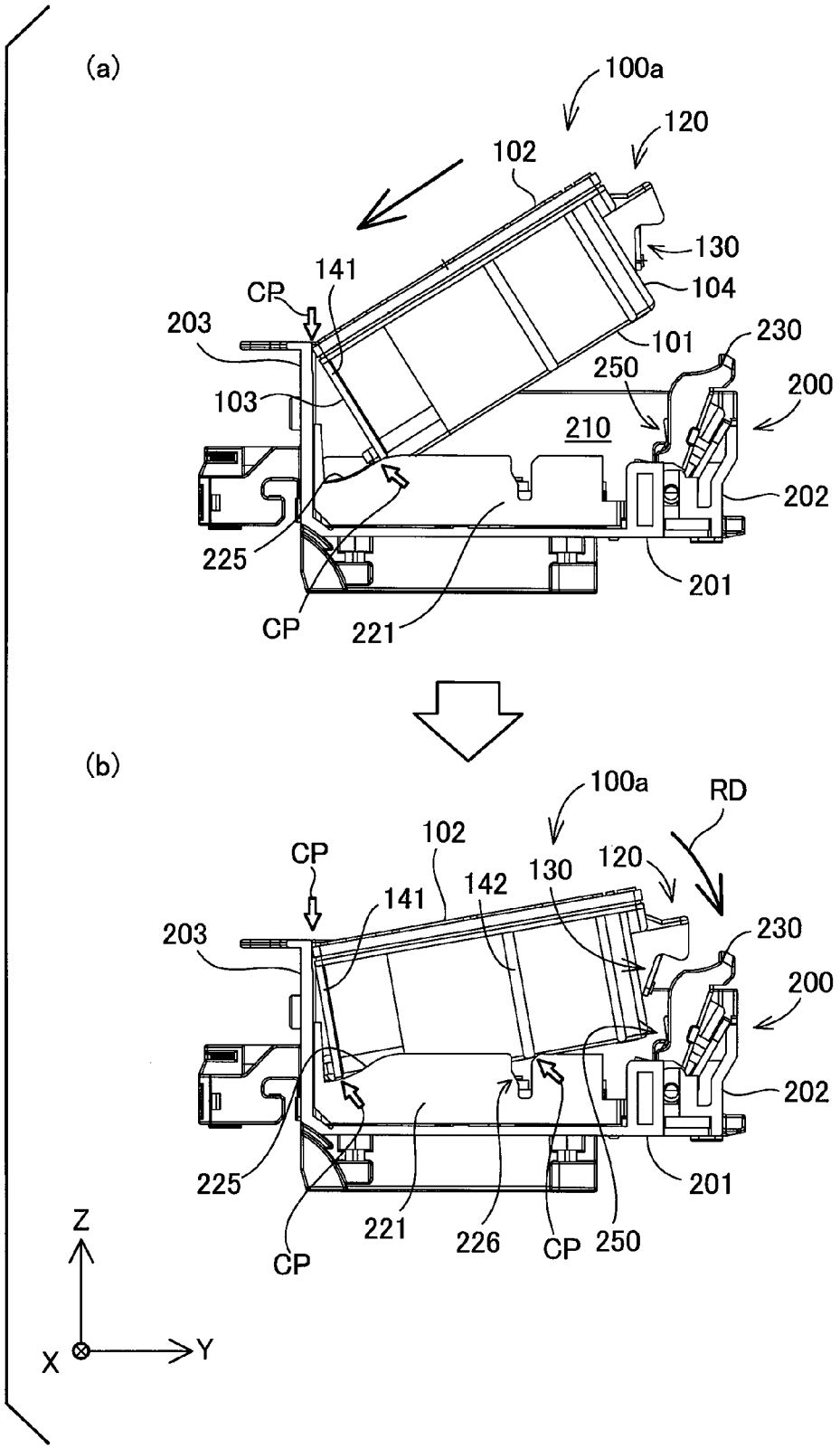
FIG. 22 is schematic diagrams illustrating an attachment process of the first cartridge to the holder structure in time series.
Figure 23:
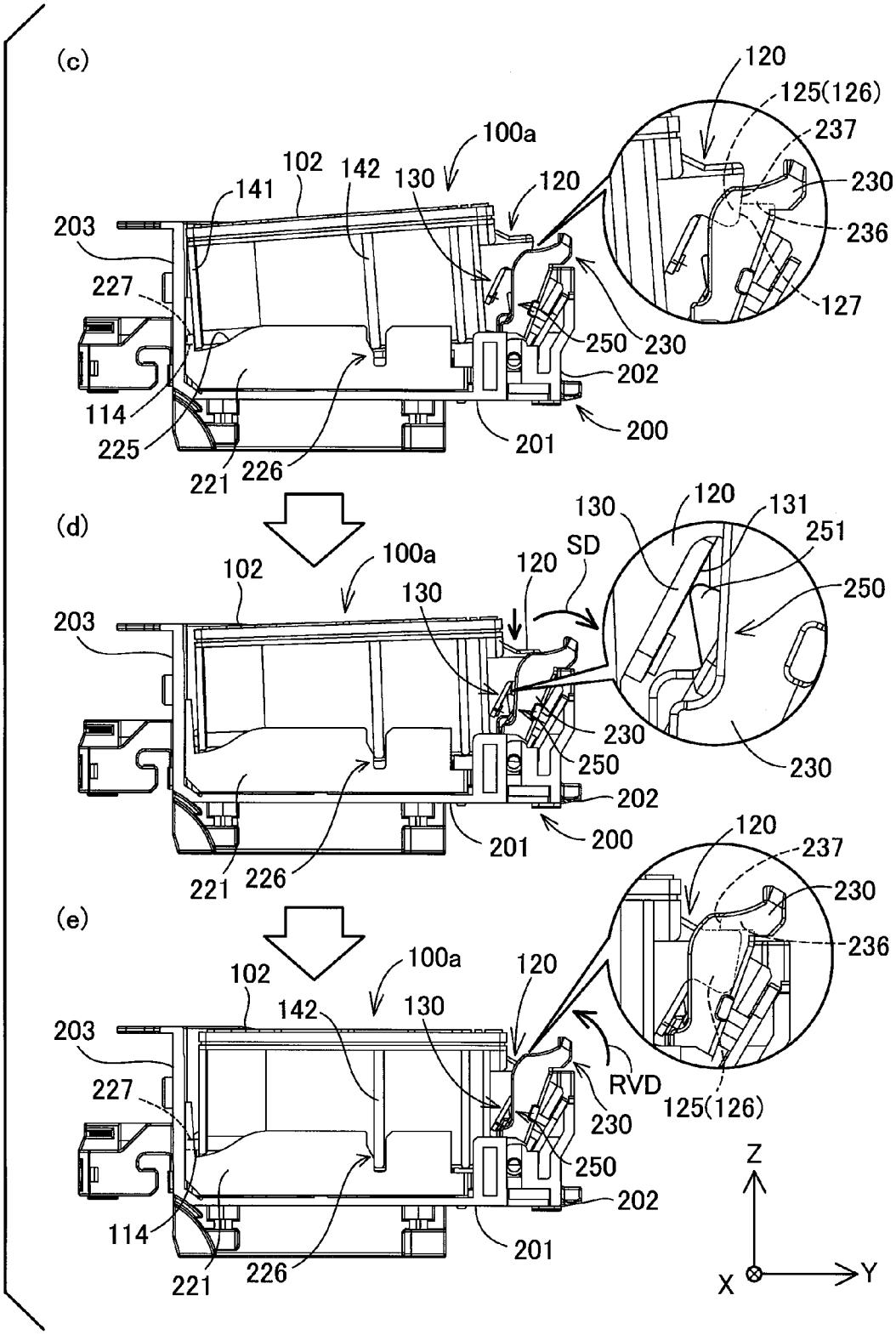
FIG. 23 is schematic diagrams illustrating the attachment process of the first cartridge to the holder structure in time series.

FIGS. 22 and 23 are schematic diagrams illustrating an attachment process of the first cartridge 100*a* to the holder structure 200 in time series. Sections (a) and (b) of FIG. 22 and sections (c), (d) and (e) of FIG. 23 sequentially show the process of attachment of the first cartridge 100*a* to the holder structure 200. As a matter of convenience, the first side wall 204 of the holder structure 200 is omitted from the illustrations of FIGS. 22 and 23. Arrows CP in FIG. 22 indicate the positions where the first cartridge 100*a* is in contact with the holder structure 200. The attachment process of the second cartridge 100*b* to the holder structure 200 is substantially the same as the attachment process of the first cartridge 100*a* and is thus neither specifically illustrated nor described herein.

In a first step as shown in section (a) of FIG. 22, the first cartridge 100*a* is inclined with the third wall 103-side facing down and is brought closer to the holder structure 200. The upper edge of the third wall 103 of the first cartridge 100*a* then comes into contact with the upper edge of the rear wall 203 of the holder structure 200, whereas the lower edges of the first ribs 141 at the rear ends of the fifth wall 105 and the sixth wall 106 come into contact with the upper edges of the first sub-wall members 221.

In a second step as shown in section (b) of FIG. 22, the first cartridge 100*a* is rotated and moved downward as shown by an arrow RD about the contact between the upper edge of the rear wall 203 of the holder structure 200 and the upper edge of the third wall 103 of the first cartridge 100*a* as the supporting point. In this state, the lower edges of the first ribs 141 slide and move along the upper surfaces of the sloped sections 225 of the first sub-wall members 221. The lower edges of the second ribs 142 come into contact with the upper edges of the cuts 226 of the first sub-wall members 221.

In a third step as shown in section (c) of FIG. 23, the main engagement part 120 of the first cartridge 100*a* comes into contact with the lever member 230 of the holder section 200. More specifically, front end faces 127 of the first side wall portion 125 and the second side wall portion 126 of the main engagement part 120 are in surface contact with the rear end face 237 of the flat plate part 236 in the bridging section 232 of the lever member 230. The plurality of projections 114 provided at the lower edge of the third wall 103 of the first cartridge 100*a* are inserted into the corresponding fitting holes 227 of the holder structure 200. The first cartridge 100*a* is then rotated and moved about the contacts between the projections 114 and the fitting holes 227 as the supporting points.

In a fourth step as shown in section (d) of FIG. 23, the rotating and moving the first cartridge 100*a* continues, so that the main engagement part 120 moves downward. The lever member 230 is pressed by the first side wall portion 125 and the second side wall portion 126 of the main engagement part 120 to be rotated and moved forward, i.e., in the direction away from the main engagement part 120 (as shown by an arrow SD). In the description herein, "moving in the direction away from" is not limited to moving to be actually away from an object but also includes moving in a direction opposite to an object with keeping the distance from the object unchanged.

In the first cartridge 100*a* of the embodiment, the lever member 230 is rotated and moved by the pressure of the main engagement part 120. This configuration does not require the rotating and moving action of the lever member 230 by the user's finger. Especially, in the configuration of the embodiment, the lever member 230 is pressed at the two points separate from each other in the direction of the arrow X by the first side wall portion 125 and the second side wall portion 126 of the main engagement part 120. The lever member 230 is thus stably rotated and moved under restriction of inclination in the direction of the arrow X.

In the fourth step, the contacts CP of the respective terminals 151 to 159 of the terminal part 131 on the circuit substrate 130 of the first cartridge 100*a* as shown in FIG. 17 come into contact with the corresponding terminals 261 to 269 of the device-side terminal assembly 250 of the holder structure 200 as shown in FIG. 9. Accompanied with the downward move of the first cartridge 100*a*, the contacts CP of the respective terminals 151 to 159 on the circuit substrate 130 of the first cartridge 100*a* are slid against the surfaces of the corresponding terminals 261 to 269 of the holder structure 200. The term "sliding" herein means relatively moving in the direction causing friction.

Such sliding removes extraneous matters such as stains or blots on the surfaces of the contacts CP of the respective terminals 151 to 159 of the circuit substrate 130 and the surfaces of the respective terminals 261 to 269 of the device-side terminal assembly 250, thus ensuring the better contact between the terminals. Especially, in the configuration of the embodiment, the respective apexes of the terminals 261 to 269 of the device-side terminal assembly 250 come into contact with the contacts CP of the corresponding terminals 151 to 159 of the circuit substrate 130. This enhances the sliding force relative to the contacts CP of the respective terminals 151 to 159 of the circuit substrate 130.

In a fifth step as shown in section (e) of FIG. 23, the rotating and moving the first cartridge 100*a* is completed, and the first wall 101 is supported by the bottom wall 201 of the holder structure 200. The lower edges of the second ribs 142 reach the lower edges of the cuts 226 of the first sub-wall members 221, so that the positions of the second ribs 142 are fixed. In this state, the plurality of projections 114 provided at the lower edge of the third wall 103 of the first cartridge 100*a* are inserted and fit in the corresponding fitting holes 227 of the holder structure 200. This serves as the engagement mechanism to let the first cartridge 100*a* engage with the holder structure 200.

Additionally, in the fifth step, moving the main engagement part 120 to the lowermost position releases the first side wall portion 125 from stopping at the second side wall portion 126 of the main engagement part 120 and the bridging section 232 of the lever member 230. Accordingly, the lever member 230 is returned to its rear-side initial position by the pressing mechanism 239 at its lower end as shown by an arrow RVD in FIG. 8, and its bridging section 232 moves above the respective brim sections 121 and 123 of the main engagement part 120. The upper surfaces of the respective brim sections 121 and 123 are then in surface contact with the lower surface of the flat plate part 236 of the lever member 230, so that the main engagement part 120 is engaged with the lever member 230. This series of steps causes the first cartridge 100*a* to be attached to the holder structure 200.

[State of Attachment of Respective Cartridges to Holder Structure]

Figure 24:
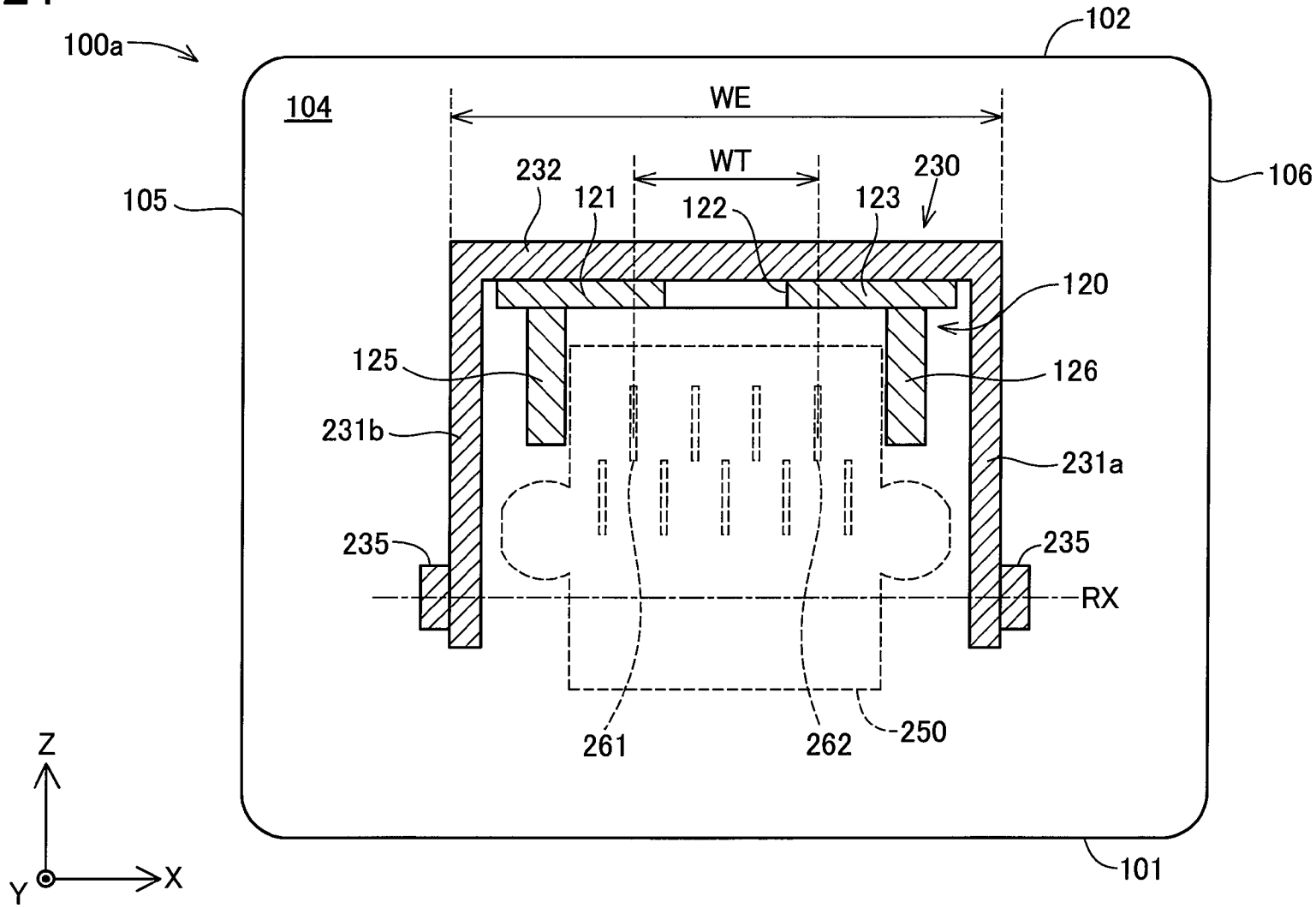
FIG. 24 is a diagram illustrating the engagement of the lever member and the electrical connectivity of a device-side terminal assembly.

FIG. 24 is a diagram illustrating the engagement of the lever member 230 and the electrical connectivity of the device-side terminal assembly 250. FIG. 24 schematically illustrates the lever member 230, the main engagement part 120 and the device-side terminal assembly 250 in the state that the first cartridge 100*a* is attached to the holder structure 200. As a matter of convenience, the array configuration of the respective terminals 261 to 269 on the terminal assembly surface 251 of the device-side terminal assembly 250 are illustrated by the broken lines in FIG. 24. The following description with reference to FIG. 24 is also applicable to the state of attachment of the second cartridge 100*b* to the holder structure 200.

In the lever member 230, the respective ends of the bridging section 232 are equally supported by the first and the second leg sections 231*a* and 231*b*. Such supporting suppresses the bridging section 232 from being inclined to the direction of the arrow X during rotating and moving the lever member 230. This stabilizes the attitude of the first cartridge 100*a* with the main engagement part 120 engaged with the bridging section 232. Especially, in the configuration of the embodiment, the bridging section 232 of the lever member 230 is extended over the entire length of the main engagement part 120 in the direction of the arrow X. This enhances the engagement of the lever member 230 with the main engagement part 120 and further stabilizes the attitude of the first cartridge 100*a*.

In the state that the first cartridge 100*a* is attached to the holder structure 200, the center of the main engagement part 120 in the direction of the arrow X is located at substantially the same position as that of the center of the lever member 230 in the direction of the arrow X. This configuration suppresses a bias of the engagement force of the lever member 230 with respect to the main engagement part 120 in the direction of the arrow X, thus further enhancing the stability of the attitude of the first cartridge 100*a*.

The rotation axis RX of the lever member 230 is located near to the lower end of the device-side terminal assembly 250. The distance between the bridging section 232 and the rotation axis RX in the direction of the arrow Z is sufficiently longer than the distance between the bridging section 232 and the lower end of the respective terminals 261 to 269 of the device-side terminal assembly 250. The lever member 230 of this embodiment thus ensures the sufficient radius of rotation for the bridging section 232. This enhances the force applied by the pressing mechanism 239 as shown in FIGS. 7 and 8 in the direction of pressing the bridging section 232 toward the main engagement part 120 (direction opposite to the direction of the arrow Y) in accordance with the principle of leverage and enhances the engagement of the lever member 230 with the main engagement part 120. This also reduces the force to be applied by the user to rotate and move the lever member 230 in the course of attachment or detachment of the first cartridge 100*a*. Additionally, this ensures the distance (stroke) for rotating and moving the bridging section 232 of the lever member 230 and accordingly improves the user's operability.

In the lever member 230 of the embodiment, a distance WE between the respective ends of the bridging section 232 in the direction of the arrow X is wider than an interval WT in the direction of the arrow X between the first and the second terminals 261 and 262 located on the respective ends of the device-side terminal assembly 250. The interval WT in the direction of the arrow X between the first and the second terminals 261 and 262 means the distance between the centerlines of the respective terminals 261 and 262. This configuration that the interval between the first and the second terminals 261 and 262 is narrower than the width of the bridging section 232 reduces the amount of positional misalignment of the respective terminals 261 to 269 of the device-side terminal assembly 250 from a specified position even when the bridging section 232 is inclined. This enhances the connectivity of the respective terminals 261 to 269 of the device-side terminal assembly 250 with the contacts CP of the corresponding terminals 151 to 159 of the circuit substrate 130.

Especially, in this embodiment, in the state that the first cartridge 100*a* is attached to the holder structure 200, the center of the lever member 230 in the direction of the arrow X is substantially aligned with the center position of the first and the second terminals 261 and 262 of the device-side terminal assembly 250. This configuration further suppresses the positional misalignment of the respective terminals 261 to 269 of the device-side terminal assembly 250 accompanied with the inclination of the bridging section 232.

Additionally, in this embodiment, in the state of attachment of the first cartridge 100*a*, the device-side terminal assembly 250 is located below the bridging section 232. Accordingly, in the state that the lever member 230 is engaged with the main engagement part 120, the circuit substrate 130 is pressed downward against the device-side terminal assembly 250. This enhances the engagement of the lever member 230 with the main engagement part 120 and thereby enhances the connectivity between the device-side terminal assembly 250 and the circuit substrate 130.

Figure 25:
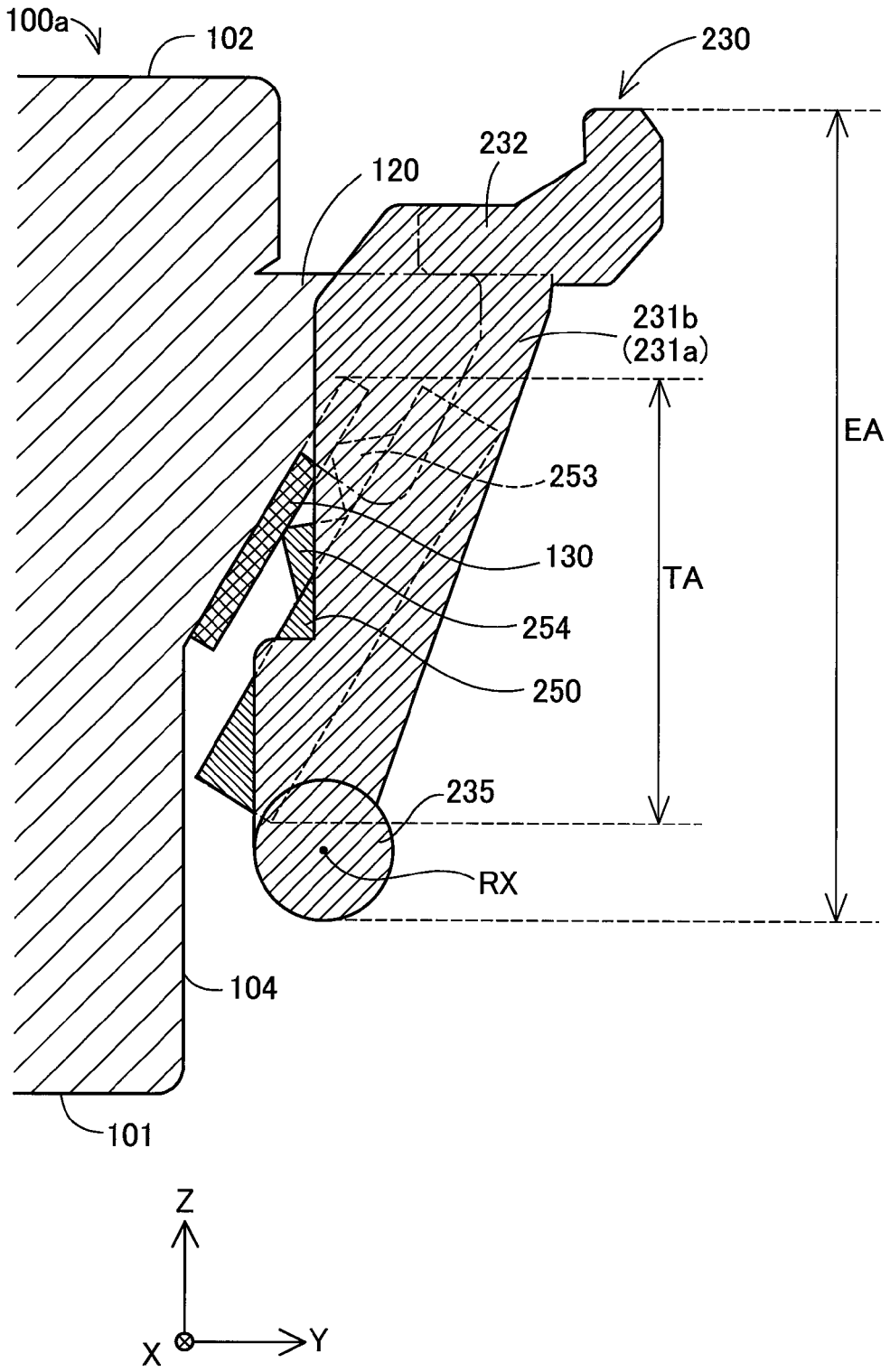
FIG. 25 is a diagram illustrating improvement of the space use efficiency of the lever member.

FIG. 25 is a diagram illustrating improvement of the space use efficiency of the lever member 230. FIG. 25 schematically illustrates the state that the lever member 230 of the holder structure 200 is engaged with the main engagement part 120 of the first cartridge 100*a* in its side view. The following description regarding the first cartridge 100*a* with reference to FIG. 25 is also applicable to the second cartridge 100*b*.

In the printing device 10 of the embodiment, an area EA occupied by the engagement mechanism between the lever member 230 and the main engagement part 120 is substantially overlapped in the height direction as shown by the arrow Z with an area TA occupied by the electric connection mechanism between the device-side terminal assembly 250 and the circuit substrate 130. More specifically, the area TA occupied by the electric connection mechanism is included in the area EA occupied by the engagement mechanism. In the printing device 10 of the embodiment, the engagement mechanism and the electric connection mechanism between the first cartridge 100*a* and the holder structure 200 are arranged intensively. This ensures the high space use efficiency in the printing device 10.

In order to achieve the advantageous effect of the lever member 230 based on the principle of leverage described above and ensure the radius of rotation of the lever member 230, it is not easy to reduce the range of the area EA in the height direction occupied by the engagement mechanism. A configuration that the above two areas EA and TA are separately arranged in the height direction increases the total range occupied by the engagement mechanism and the electric connection mechanism and is likely to decrease the space use efficiency. The "configuration that the two areas EA and TA are separately arranged in the height direction" includes the configuration that the two areas EA and TA are separately arranged in the height direction with some overlap. As described above, the arrangement and the configuration of the lever member 230 and the device-side terminal assembly 250 in the printing device 10 of the embodiment improve the operability of the first cartridge 100*a* and enhance the space use efficiency in the printing device 10.

As described above, the holder structure 200 of the embodiment has the lever member 230 and thereby enhances the fit of the first and the second cartridges 100*a* and 100*b* and improves the operability in the course of attachment or detachment of the first and the second cartridges 100*a* and 100*b*. Additionally, the configuration of the embodiment enhances the space use efficiency of the mechanism for attachment of the first and the second cartridges 100*a* and 100*b* in the printing device 10.

B. Second Embodiment

Figure 26:
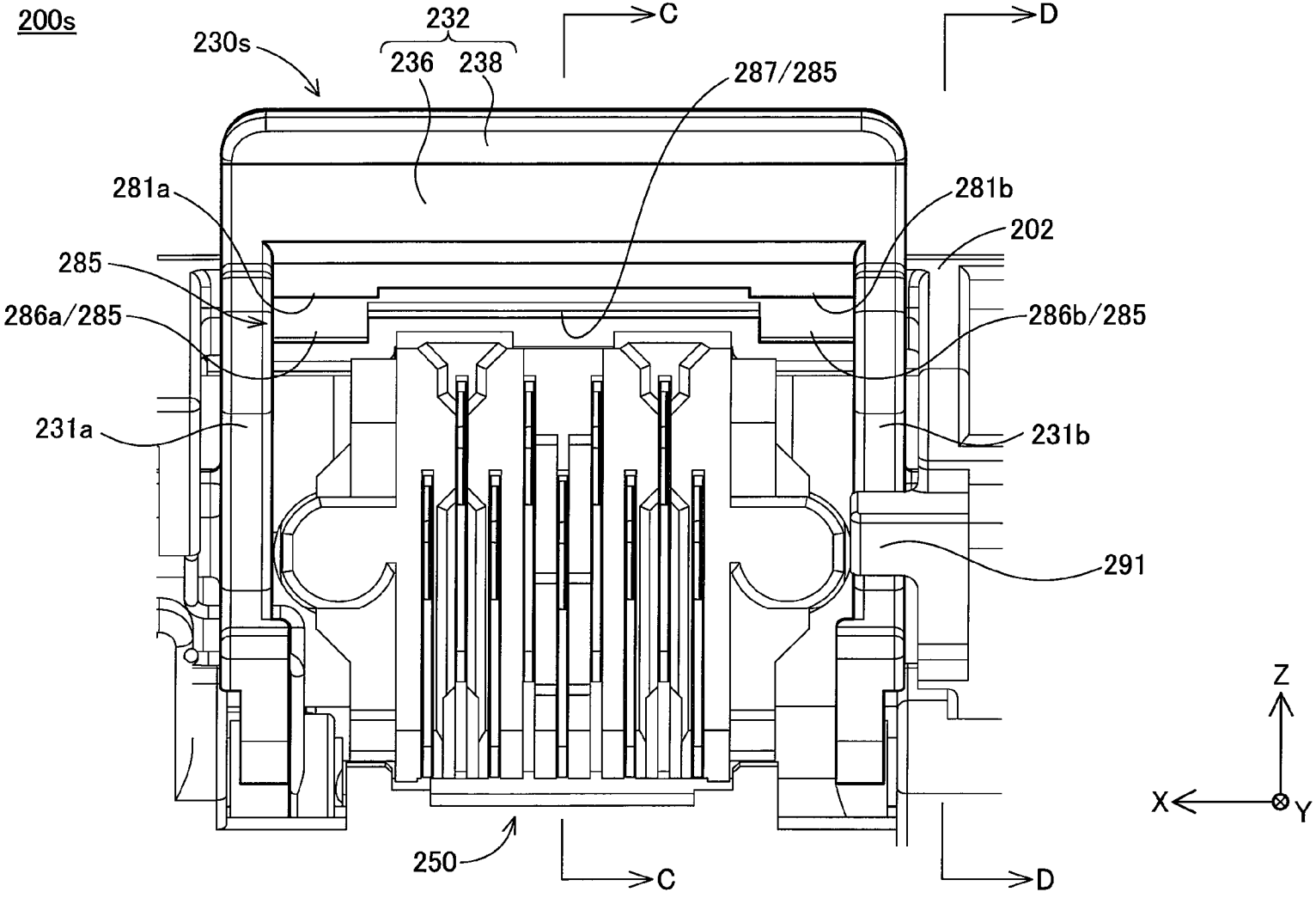
FIG. 26 is a schematic diagram illustrating the structure of a lever member according to a second embodiment.
Figure 27:
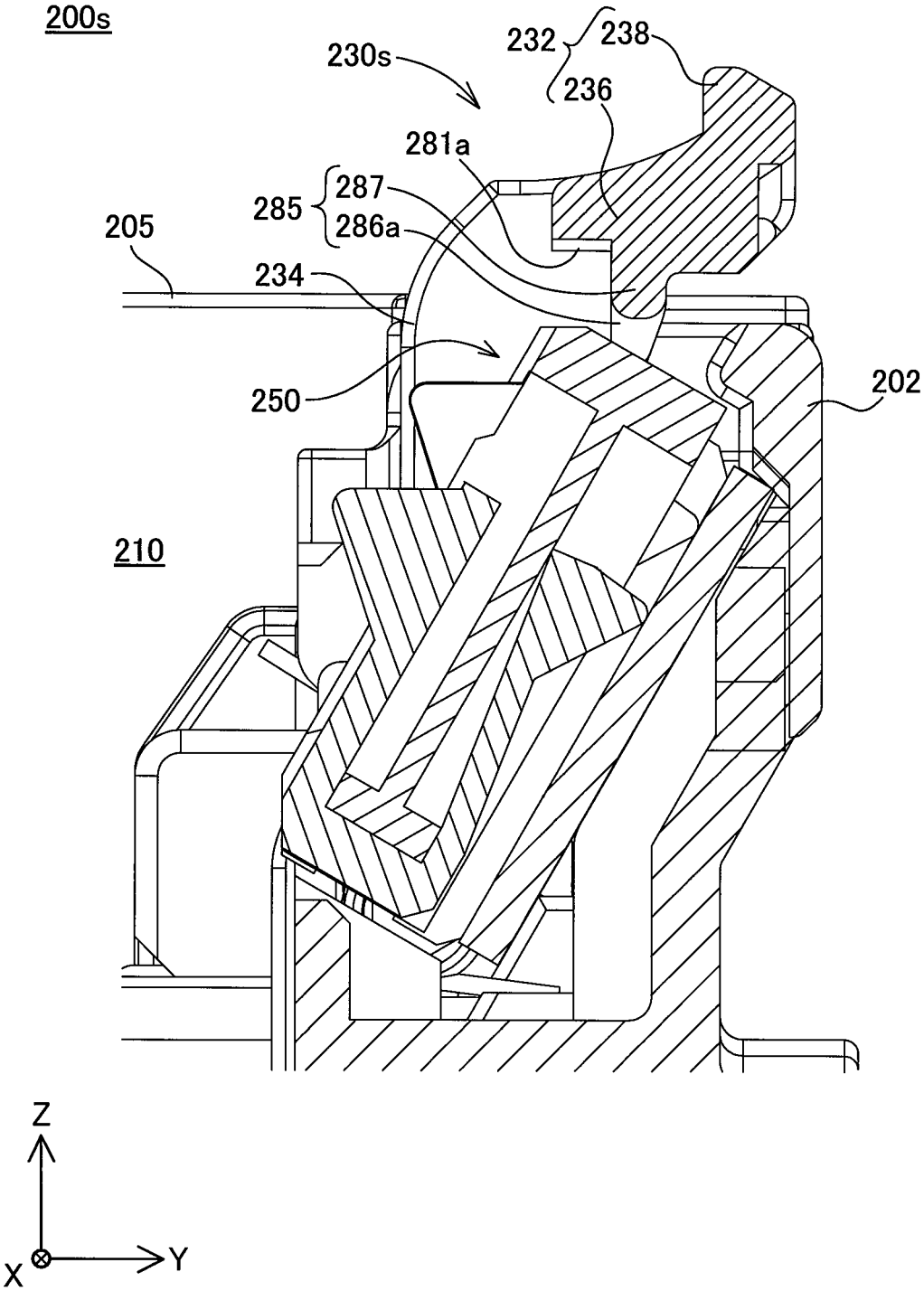
FIG. 27 is a schematic diagram illustrating the structure of the lever member of the second embodiment.
Figure 28:
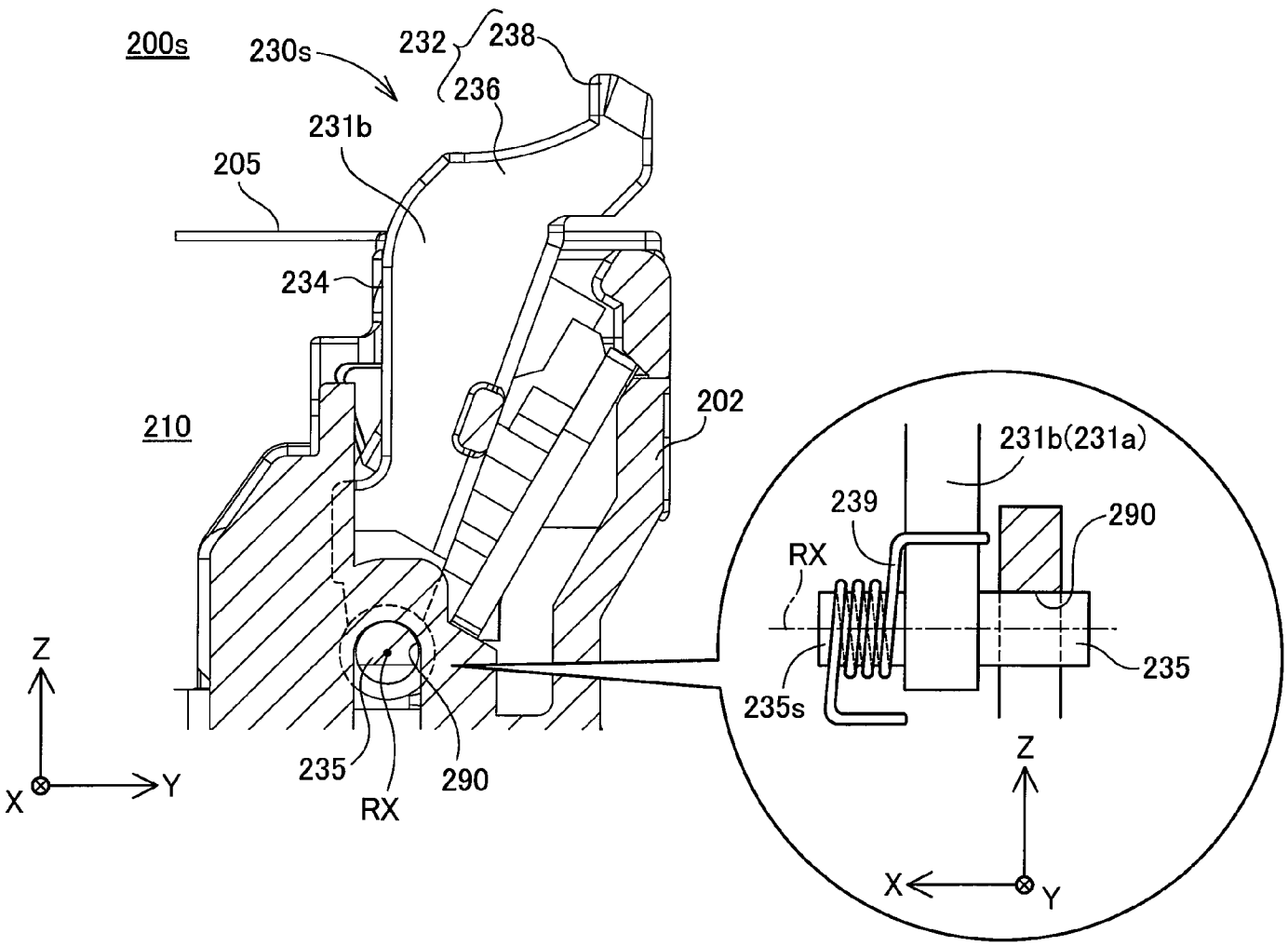
FIG. 28 is a schematic diagram illustrating the structure of the lever member of the second embodiment.

The following describes the structure of a lever member 230*s* included in a holder structure 200*s* according to a second embodiment of the invention with reference to FIGS. 26 to 28. FIGS. 26 to 28 illustrate the lever member 230*s* attached to a front wall 202 of the holder structure 200*s*. FIG. 26 illustrates the lever member 230*s* viewed in the direction of the arrow Y with part of the front wall 202. FIGS. 27 and 28 are schematic cross sectional views illustrating the lever member 230*s* and the front wall 202, respectively taken on a line C-C and a line D-D in FIG. 26. FIG. 28 also illustrates an attachment structure at an end of a second leg section 231*b* of the lever member 230*s* in a balloon. The holder structure 200*s* of the second embodiment has configuration substantially similar to the configuration of the holder structure 200 of the first embodiment FIGS. 4 to 6), except the lever member 230*s*. In the description below, the like components to those of the first embodiment are expressed by the like numerical symbols to those of the first embodiment.

The lever member 230*s* of the second embodiment has structure substantially similar to the structure of the lever member 230 of the first embodiment, except that a first projection 281*a*, a second projection 281*b* and a stopping wall 285 are provided between first and second leg sections 231*a* and 231*b*. The two projections 281*a* and 281*b* are protruded downward from the lower surface of a flat plate part 236 of a bridging section 232 as shown in FIGS. 27 and 28. In the second embodiment, the two projections 281*a* and 281*b* are made as walls extended at an equal height in the direction of the arrow X.

The first projection 281*a* and the second projection 281*b* are provided on the respective ends in the bridging section 232 in the direction of the arrow X to be away from each other and are aligned on an identical axial line in the direction of the arrow X. The first projection 281*a* is adjacent to the first leg section 231*a*, and the second projection 281*b* is adjacent to the second leg section 231*b*. The first projection 281*a* and the second projection 281*b* are arranged symmetrically about the centerline of the lever member 230*s* in the direction of the arrow X.

In the state that each of the cartridges 100*a* and 100*b* is attached to the holder structure 200*s*, the first projection 281*a* and the second projection 281*b* come into contact with the upper surface of the main engagement part 120 of each of the cartridges 100*a* and 100*b*. The functions of the first projection 281*a* and the second projection 281*b* will be described later in detail.

The stopping wall 285 is made as a wall protruded downward below the first projection 281*a* and the second projection 281*b* at a position backward of the first projection 281*a* and the second projection 281*b* in the direction of the arrow Y. The stopping wall 285 is formed over the substantially entire length between the first and the second leg sections 231*a* and 231*b*. In the state that each of the cartridges 100*a* and 100*b* is attached to the holder structure 200*s*, the stopping wall 285 works as a rotation limiter to limit the rotation and the move of the lever member 230*s* toward the cartridge 100*a* or 100*b* (described later in detail).

The stopping wall 285 has a first end region 286*a*, a second end region 286*b* and a center region 287. The first and the second end regions 286*a* and 286*b* are regions in an approximately rectangular shape respectively formed at the positions adjacent to the first and the second leg sections 231*a* and 231*b*. The center region 287 is a region formed between the first and the second end regions 286*a* and 286*b* to have an equal height in the direction of the arrow X (i.e., width in the direction of the arrow Z). The first and the second end regions 286*a* and 286*b* are respectively protruded below the center region 287. The lower height of the center region 287 of the stopping wall 285 suppresses the lever member 230*s* from interfering with the device-side terminal assembly 250 located below the bridging section 232 in the course of rotation and move of the lever member 230*s*.

The lever member 230*s* of the second embodiment is rotated and moved by a mechanism similar to that of the lever member 230 of the first embodiment as shown in FIG. 28. The front wall 202 of the holder structure 200*s* has fitting grooves 290 open in the direction of the arrow X. Convexes 235 provided at the respective lower edges of the first and the second leg sections 231*a* and 231*b* are fit in the corresponding fitting grooves 290 formed as concaves, so that the lever member 230*s* is attached to the holder structure 200*s* in a rotatable manner.

An inner convex 235*s* is formed at the lower edge of each of the first and the second leg sections 231*a* and 231*b* of the lever member 230*s* to be protruded in the opposite direction to that of the convex 235 serving as the rotating shaft as shown in the balloon of FIG. 28. The torsion spring of the pressing mechanism 239 configured to press the lever member 230*s* in the direction of rotation is mounted to be fixed to the inner convex 235*s*.

The front wall 202 of the holder section 200*s* has a restriction wall 291 to restrict rotation of the second leg section 231*b* toward the cartridge chamber 210 as shown in FIG. 26. The restriction wall 291 fixes the lever member 230*s* at the initial position in the state that the lever member 230*s* is pressed by the pressing mechanism 239 toward the cartridge chamber 210.

Figure 29:
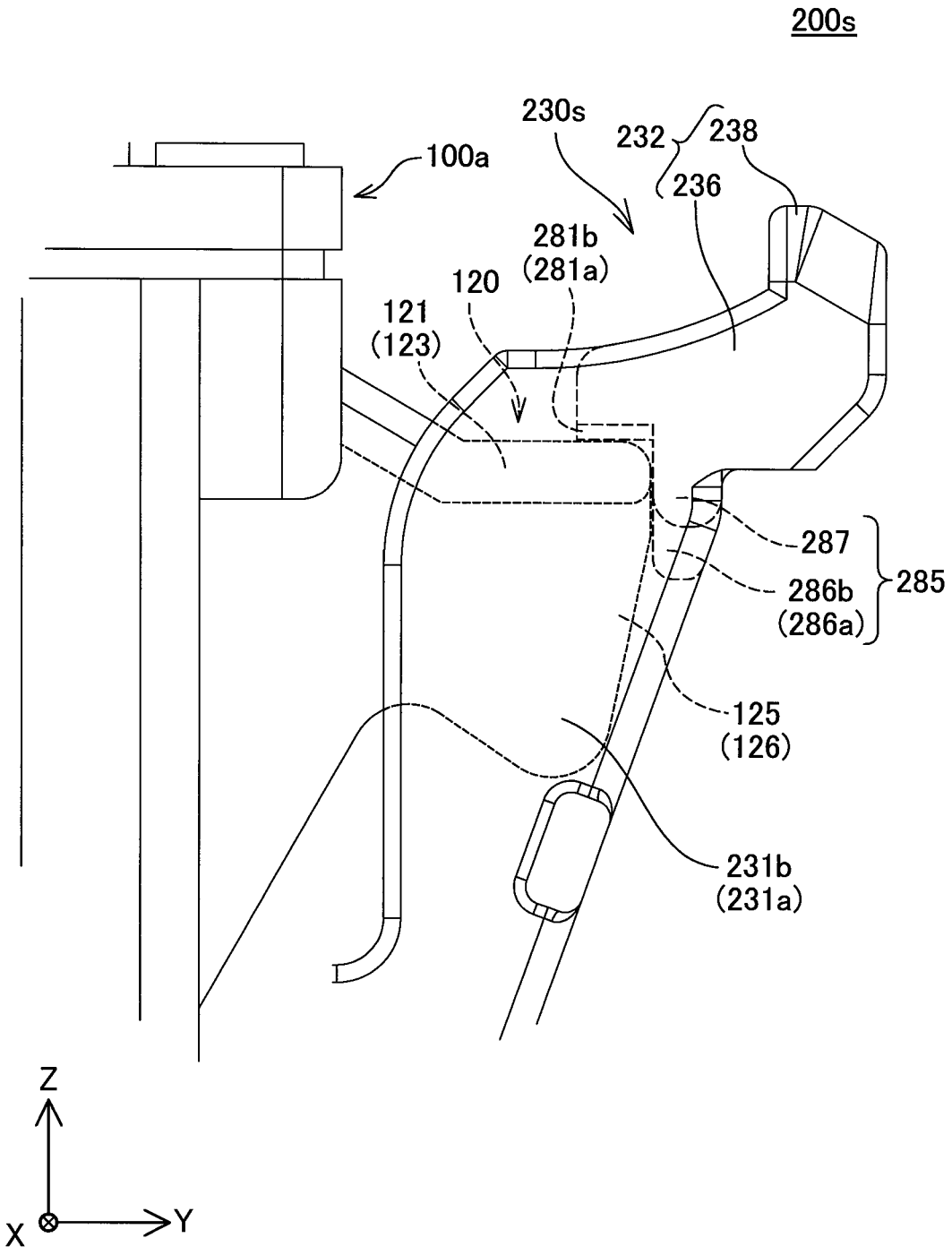
FIG. 29 is a schematic diagram illustrating the functions of a first projection, a second projection and a stopping wall of the lever member.

FIG. 29 is a schematic diagram illustrating the functions of the first projection 281*a*, the second projection 281*b* and the stopping wall 285 of the lever member 230*s*. FIG. 29 illustrates the state that the first cartridge 100*a* is attached to the holder structure 200*s* and the main engagement part 120 is stopped at the lever member 230*s*. The following description is also applicable to attachment of the second cartridge 100*b* to the holder structure 200*s*.

As described above, in the state that the first cartridge 100*a* is attached to the holder structure 200*s*, the first projection 281*a* and the second projection 281*b* of the lever member 230*s* come into contact with the upper surface of the main engagement part 120. In the holder structure 200*s* of the second embodiment, the main engagement part 120 is pressed downward at the two different positions away from each other in the direction of the arrow X. This configuration suppresses the main engagement part 120 from receiving the biased holding force in the direction of the arrow X. This accordingly suppresses the first cartridge 100*a* from being inclined in the direction of the arrow X and enables the first cartridge 100*a* to be fixed in a specified attachment state.

When the first cartridge 100*a* is attached to the holder structure 200*s*, the stopping wall 285 comes into contact with or comes closer to face the front end faces of the first brim section 121 and the second brim section 123 of the main engagement part 120. The first and the second end regions 286*a* and 286*b* of the stopping wall 285 respectively come into contact with or come closer to face the front end faces of the first side wall portion 125 and the second side wall portion 126. Even when an external force is applied to the lever member 230*s*, for example, in the direction opposite to the direction of the arrow Y, this configuration causes the lever member 230*s* to be stopped at the main engagement part 120 and suppresses the lever member 230*s* from excessively rotating and moving toward the first cartridge 100*a*. This accordingly suppresses the occurrence of failures, such as damage of the lever member 230*s* or the front wall 202 of the holder structure 200*s* caused by the excessive rotation and move of the lever member 230*s*.

As described above, in the holder structure 200*s* of the second embodiment, the lever member 230 having the first projection 281*a* and the second projection 281*b* enhances the attachment and fixation of the respective cartridges 100*a* and 100*b*. The lever member 230*s* having the stopping wall 285 improves the protection of the holder structure 200*s* in the state of attachment of the first and the second cartridges 100*a* and 100*b*.

C. Third Embodiment

Figure 30:
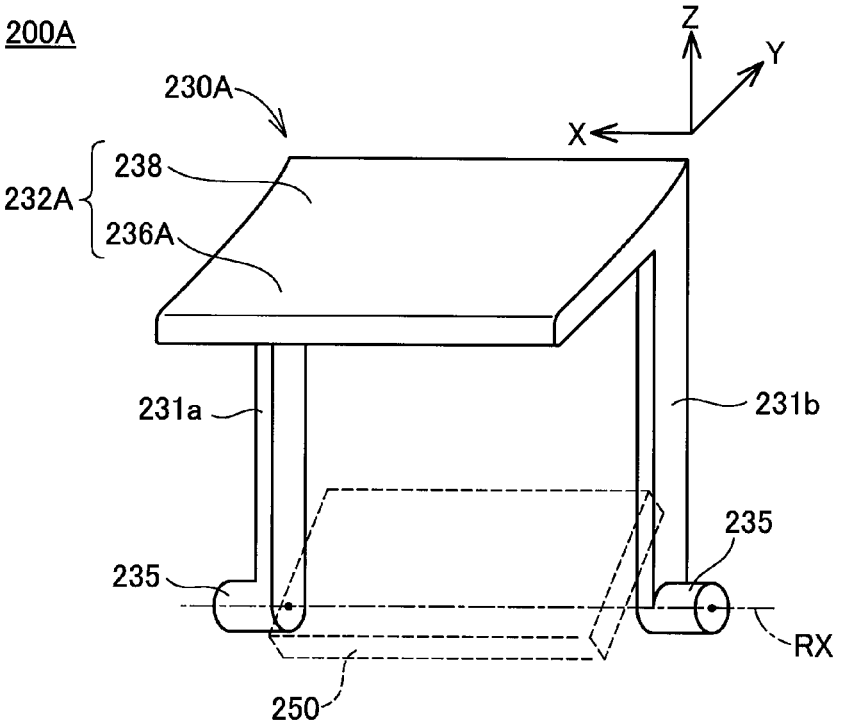
FIG. 30 is a schematic perspective view illustrating the structure of a lever member included in a holder structure according to a third embodiment of the invention.

FIG. 30 is a schematic perspective view illustrating the structure of a lever member 230A included in a holder structure 200A according to a third embodiment of the invention. As a matter of convenience, an area where a device-side engagement part 250 is arranged is illustrated by the broken line in FIG. 30. The rotation axis RX of the lever member 230A is also shown by the dashed line. The holder structure 200A of the third embodiment has configuration similar to that of the holder structure 200 described in the first embodiment as shown in FIGS. 4 to 6, except that the holder structure 200A is provided with a lever member 230A of different structure. In the description below, the like components to those of the first embodiment are expressed by the like numerical symbols.

A bridging section 232A of the lever member 230A of the third embodiment has a flat plate part 236A extended in the direction toward the cartridge chamber 210 (direction opposite to the direction of the arrow Y). In the lever member 230A of the third embodiment, first and second leg sections 231*a* and 231*b* may respectively have extension sections 234 as shown in FIG. 8 for protecting the device-side engagement part 250. The first and the second leg sections 231*a* and 231*b* may respectively have pressing mechanisms 239.

Figure 31:
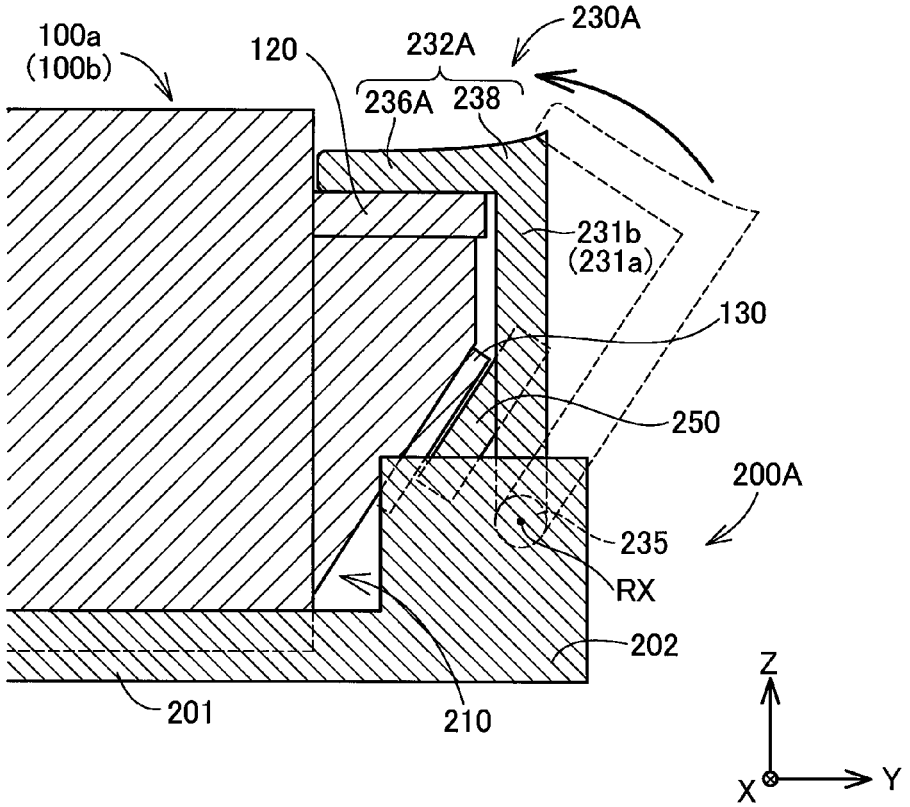
FIG. 31 is a schematic diagram illustrating the engagement state of the lever member of the third embodiment.

FIG. 31 is a schematic diagram illustrating the engagement state of the lever member 230A of the third embodiment. FIG. 31 schematically illustrates the state that the main engagement part 120 of the first cartridge 100*a* is engaged with the lever member 230A in the holder structure 200A. As a matter of convenience, the locus of the rotation and the move of the lever member 230A is shown by the broken line and the arrow. The following description regarding attachment of the first cartridge 100*a* is also applied to the second cartridge 100*b*.

In the configuration of the holder structure 200A of the third embodiment, the first cartridge 100*a* is placed in the cartridge chamber 210 after the lever member 230A is rotated and moved in the direction away from the main engagement part 120. Returning the lever member 230A to its initial position causes the flat plate part 236A of the bridging section 232A of the lever member 230A to be located above the main engagement part 120 of the first cartridge 100*a* and engages the lever member 230A with the main engagement part 120.

As described above, in the configuration of the holder structure 200A of the third embodiment, the main engagement part 120 of each of the cartridges 100*a* and 100*b* is engaged by the rotation and the move of the bridging section 232A formed between the first and the second leg sections 231*a* and 231*b*. This enhances the attachment of the respective cartridges 100*a* and 100*b*. Additionally, the holder structure 200A of the third embodiment has the similar functions and advantageous effects to those of the holder structure 200 of the first embodiment.

D. Fourth Embodiment

Figure 32:
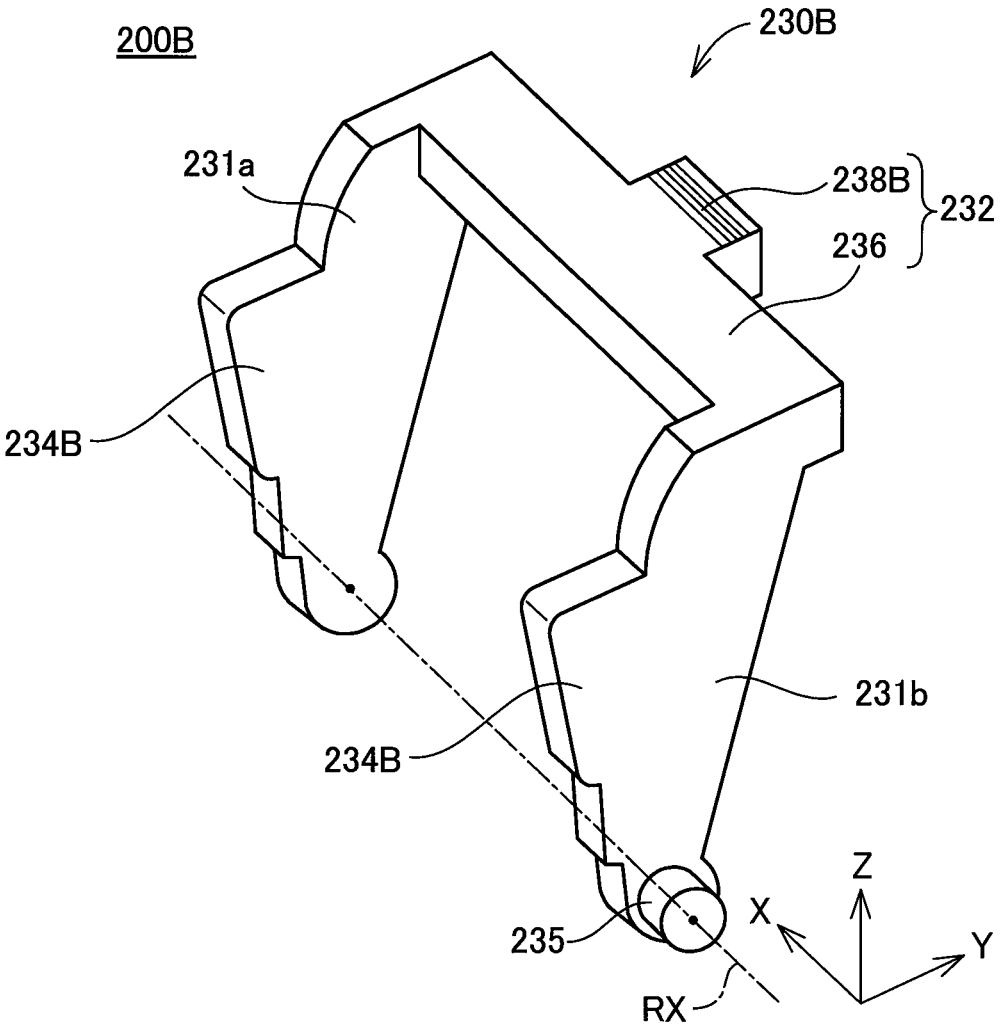
FIG. 32 is a schematic perspective view illustrating the structure of a lever member included in a holder structure according to a fourth embodiment of the invention.

FIG. 32 is a schematic perspective view illustrating the structure of a lever member 230B included in a holder structure 200B according to a fourth embodiment of the invention. The rotation axis RX of the lever member 230B is shown by the dashed line in FIG. 32. The holder structure 200B of the fourth embodiment has configuration similar to that of the holder structure 200 described in the first embodiment as shown in FIGS. 4 to 6, except that the holder structure 200B is provided with a lever member 230B of different structure. In the description below, the like components to those of the first embodiment are expressed by the like numerical symbols.

The lever member 230B of the fourth embodiment has substantially similar structure to that of the lever member 230 of the first embodiment, except the following characteristics. In the lever member 230B of the fourth embodiment, extension sections 234B are extended from the end faces of first and second leg sections 231*a* and 231*b* along the direction toward the cartridge chamber 210 in the direction opposite to the direction of the arrow Y and along the direction of attachment of each of the cartridges 100*a* and 100*b* in the direction of the arrow Z. As described below, the extension sections 234B serve to protect all the terminals 261 to 269 on the terminal assembly surface 251 of the device-side terminal assembly 250.

In the lever member 230B of the fourth embodiment, an operating part 238B of a bridging section 232 is provided to be extended forward in the direction of the arrow Y at a local position on the approximate center in the direction of the arrow X of a flat plate part 236. Accordingly, in the lever member 230B of the fourth embodiment, the user applies a force at the approximate center position of the bridging section 232 in the course of rotation and move of the lever member 230. This configuration stabilizes the rotation and move of the lever member 230B and suppresses inclination of the bridging section 232.

Figure 33:
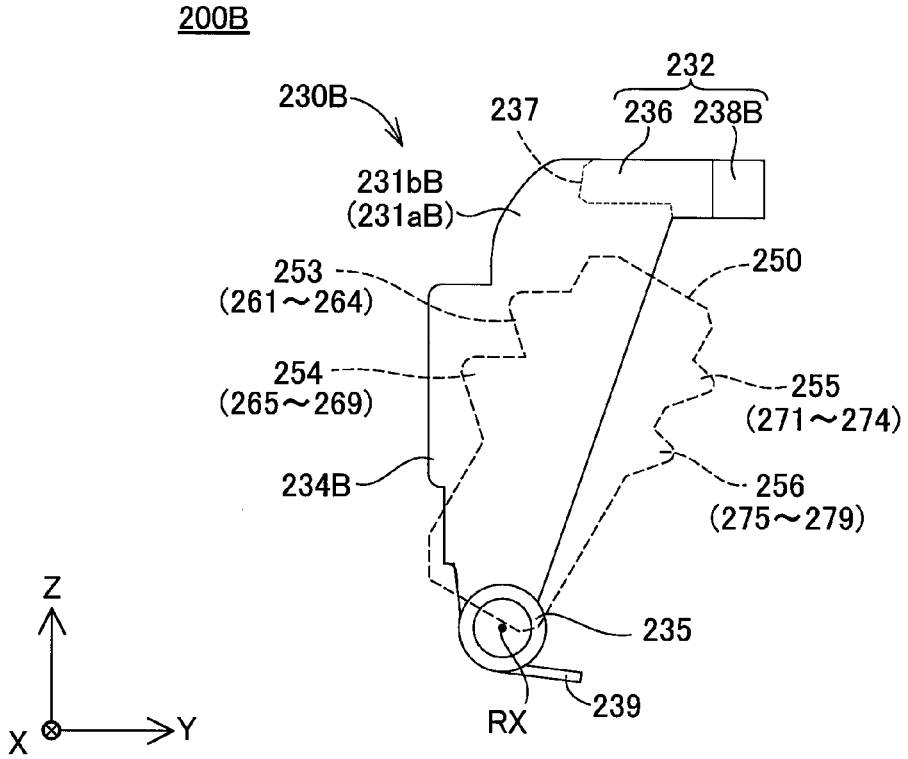
FIG. 33 is a schematic diagram illustrating protection of a device-side terminal assembly by extension sections of the lever member of the fourth embodiment.

FIG. 33 is a schematic diagram illustrating protection of the device-side terminal assembly 250 by the extension sections 234B of the lever member 230B. FIG. 33 illustrates the lever member 230B viewed from the side surface direction as shown by the arrow X, together with the location where the device-side terminal assembly 250 is arranged by the broken line. In the holder structure 200B of the fourth embodiment, when the lever member 230B is neither rotated or moved and is located at the initial position, the extension sections 234B are overlapped with all the terminals 261 to 269 on the terminal assembly surface 251 of the device-side terminal assembly 250 in the direction of the arrow X. In other words, the respective terminals 261 to 269 of the device-side terminal assembly 250 are placed between the extension sections 234B. This configuration enhances the protection of the respective terminals 261 to 269.

As described above, the configuration of the holder structure 200B of the fourth embodiment stabilizes the rotation and the move of the lever member 230 and enhances attachment of the respective cartridges 100*a* and 100*b*. This configuration also enhances the protection of the device-side terminal assembly 250. Additionally, the holder structure 200B of the fourth embodiment has the similar functions and advantageous effects to those of the holder structure 200 of the first embodiment.

E. Fifth Embodiment

Figure 34:
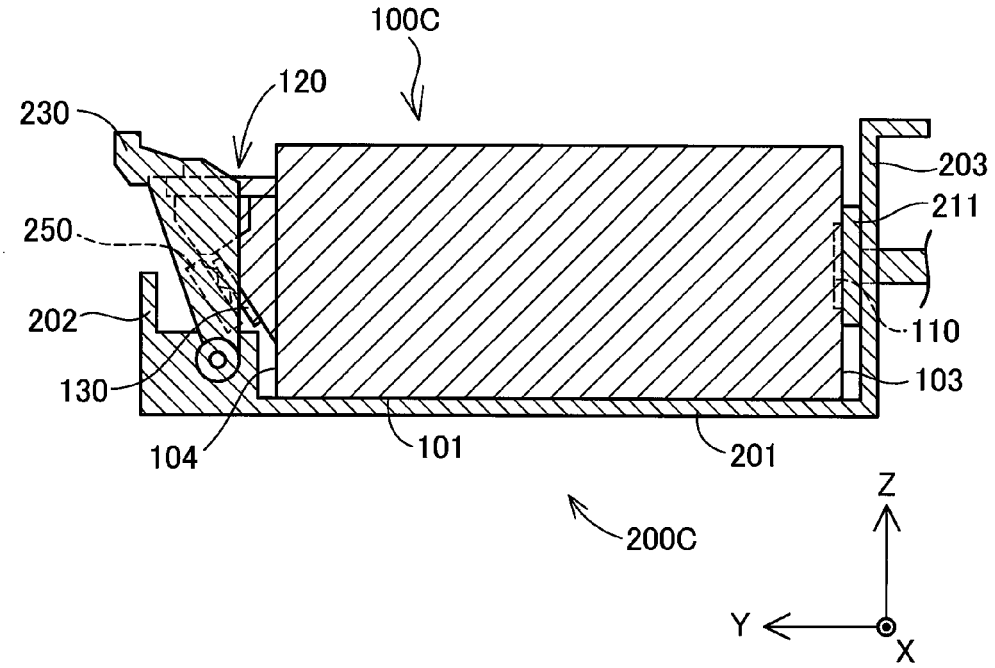
FIG. 34 is a schematic diagram illustrating the configuration of a holder structure according to a fifth embodiment.

FIG. 34 is a schematic diagram illustrating the configuration of a holder structure 200C according to a fifth embodiment of the invention. The like components of FIG. 34 to those of the first embodiment are expressed by the like numerical symbols. The holder structure 200C of the fifth embodiment is provided on the carriage 27 of the printing device 10 as shown in FIGS. 1 and 2. Two different types of ink cartridges similar to the first and the second cartridges 100*a* and 100*b* described in the first embodiment are attachable to and detachable from the holder structure 200C of the fifth embodiment. Since a similar mounting mechanism is employed in the respective types of cartridges, the following describes only a cartridge 100C similar to the first cartridge 100*a* as a matter of convenience.

The holder structure 200C and the cartridge 100C of the fifth embodiment have substantially similar configurations to those of the holder structure 200 and the first cartridge 100*a* of the first embodiment, except the following characteristics. In the cartridge 100C of the fifth embodiment, an ink supply port 110 is provided not in the first wall 101 but in the third wall 103. Accordingly, in the holder structure 200C of the fifth embodiment, an ink receiving part 211 is provided on the rear wall 203.

Irrespective of the ink supply port 110 and the ink receiving part 211 formed at the different positions, the holder structure 200*c* engages with the cartridge 100C by the same lever member 230 as that described in the first embodiment. Accordingly, the holder structure 200C of the fifth embodiment has similar functions and advantageous effects to those of the holder structure 200 of the first embodiment.

F. Sixth Embodiment

Figure 35:
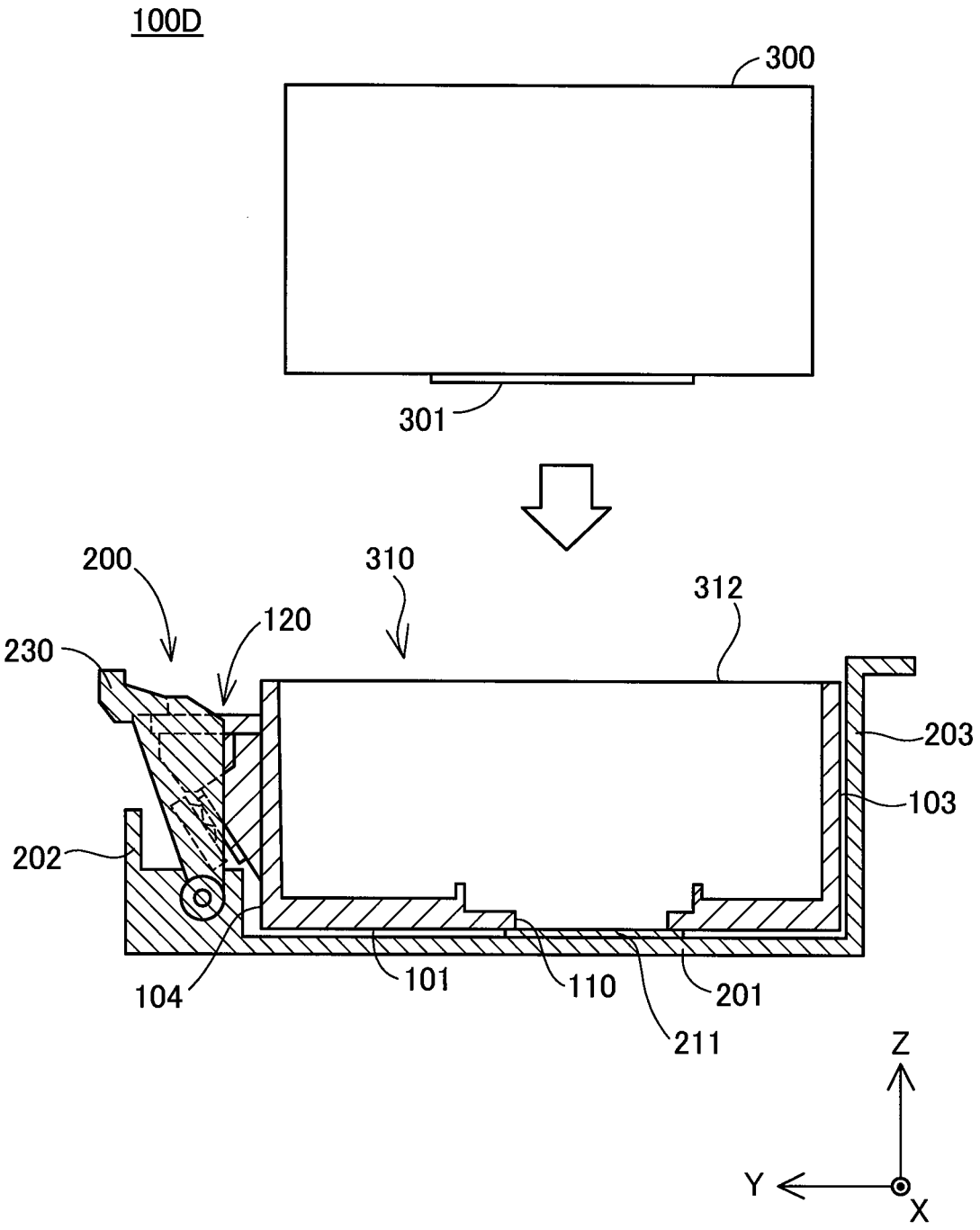
FIG. 35 is a schematic diagram illustrating the structure of a cartridge according to a sixth embodiment of the invention.

FIG. 35 is a schematic diagram illustrating the structure of a cartridge 100D as a liquid supply unit according to a sixth embodiment of the invention. The like components of FIG. 35 to those of the first embodiment are expressed by the like numerical symbols. The cartridge 100D of the sixth embodiment is attachable to and detachable from the carriage 27 of the printing device 10 as shown in FIGS. 1 and 2 via the holder structure 200 described in the first embodiment as shown in FIGS. 4 to 6. In the sixth embodiment, two different types of ink cartridges similar to the first and the second cartridges 100*a* and 100*b* described in the first embodiment are respectively attached to the holder structure 200. Since a similar mounting mechanism is employed in the respective types of cartridges, the following describes only the cartridge 100D similar to the first cartridge 100*a* as a matter of convenience.

The cartridge 100D of the sixth embodiment has an ink container 300 and an adaptor structure 310. The ink container 300 corresponds to the second member and is provided as a liquid container internally having an ink chamber as a liquid chamber configured to contain ink. The ink container 300 has an ink outlet port 301 on its lower surface to be connected with an ink supply port 110 of the adaptor structure 310.

The adaptor structure 310 corresponds to the first member and is an exterior vessel configured to receive the ink container 300 through an upper opening 312. The adaptor structure 310 has walls similar to the first wall 101, the third wall 103, the fourth wall 104, the fifth wall 105 and the sixth wall 106 of the first cartridge 100*a* of the first embodiment. The first or bottom wall 101 of the adaptor structure 310 has an ink supply port 110 similar to that of the first cartridge 100*a* of the first embodiment. A main engagement part 120 and a circuit substrate 130 similar to those described in the first embodiment are disposed on the fourth or front wall 104.

The cartridge 100D of the sixth embodiment causes ink to be supplied to the printing device 10 by attaching the ink container 300 to the holder structure 200 via the adaptor structure 310. In the cartridge 100D of the sixth embodiment, the adaptor structure 310 has the main engagement part 120 which is to be engaged with the lever member 230 of the holder structure 200. This configuration ensures the enhanced attachment to the holder structure 200. The cartridge 100D of the sixth embodiment accordingly ensures the enhanced attachment to the holder structure 200, like the first and the second cartridges 100*a* and 100*b* of the first embodiment.

G. Seventh Embodiment

Figure 36:
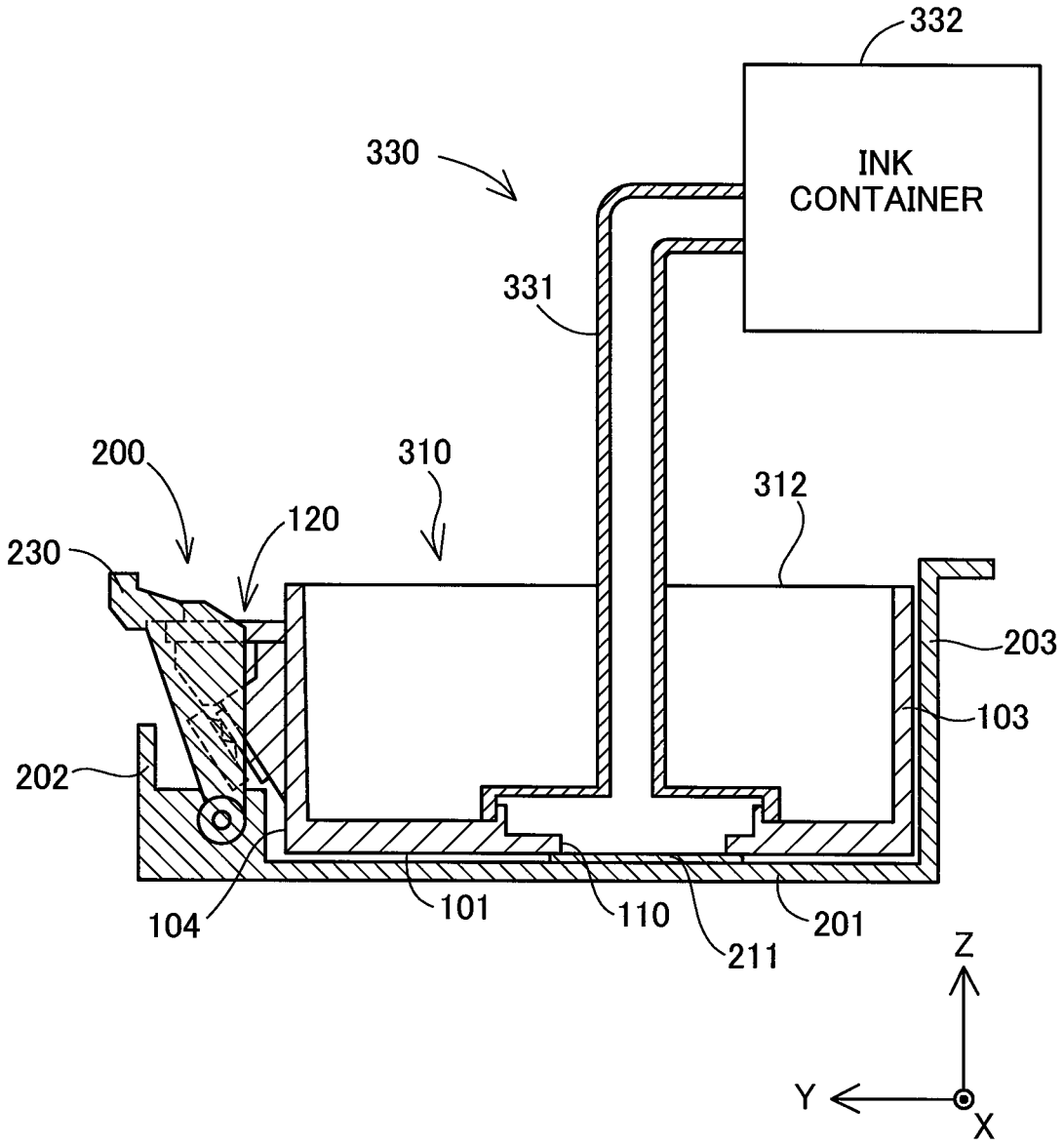
FIG. 36 is a schematic diagram illustrating the structure of a liquid supply unit according to a seventh embodiment of the invention.

FIG. 36 is a schematic diagram illustrating the structure of a liquid supply unit 330 according to a seventh embodiment of the invention. The like components of FIG. 36 to those of the first embodiment and the sixth embodiment are expressed by the like numerical symbols. The liquid supply unit 330 of the seventh embodiment is attachable to and detachable from the carriage 27 of the printing device 10 as shown in FIGS. 1 and 2 via the holder structure 200 described in the first embodiment as shown in FIGS. 4 to 6. Like the above sixth embodiment, the seventh embodiment describes only the liquid supply unit 330 similar to the first cartridge 100*a* as a matter of convenience.

The liquid supply unit 330 of the seventh embodiment has an adaptor structure 310, an ink supply tube 331 and an ink container 332. The adaptor structure 310 is similar to the adaptor structure 310 described in the sixth embodiment and has the main engagement part 120 and the circuit substrate 130 on the front or fourth wall 104 and the ink supply port 110 on the bottom or first wall 101.

The ink container 332 is a liquid container internally having an ink chamber configured to contain ink. The ink chamber of the ink container 332 is connected with the ink supply port 110 of the adaptor structure 310 via the ink supply tube 331. The ink supply tube 331 and the ink container 332 correspond to the second member.

In the liquid supply unit 330 of the seventh embodiment, the adaptor structure 310 has the main engagement part 120 which is to be engaged with the lever member 230 of the holder structure 200. This configuration ensures the enhanced attachment to the holder structure 200. The liquid supply unit 330 of the seventh embodiment accordingly ensures the enhanced attachment to the holder structure 200, like the first and the second cartridges 100*a* and 100*b* of the first embodiment.

H. Modifications

H1. Modification 1

In the first embodiment described above, the holder structure 200 has the device-side terminal assembly 250. The holder structure 200 may, however, not have the device-side terminal assembly 250. In this modification, a cartridge without the circuit substrate 130 may be attached to the holder structure 200. An electrode assembly configured to be in electrically contact with the circuit substrate 130 may be provided separately from the holder structure 200.

H2. Modification 2

In the first embodiment described above, the bridging section 232 of the lever member 230 has the flat plate part 236 which comes into contact and is engaged with the main engagement part 120 of each of the cartridges 100*a* and 100*b*. The bridging section 232 of the lever member 230 may, however, not have the flat plate part 236. For example, the bridging section 232 may have a rod-like part extended to come into contact with the main engagement part 120 or may have a plurality of abutting elements separately arranged to be in point contact with the main engagement part 120. The term "coming into contact" or "abutting" herein means that objects are in contact with each other to generate a pressure therebetween. The "contact" includes contact between flat surfaces, contact between a flat surface and a curved surface and point contact. The "contact" is not limited to direct contact between objects but includes even indirect contact between objects via some medium.

H3. Modification 3

In the first embodiment described above, the lever member 230 is engaged with the main engagement part 120 of each of the first and the second cartridges 100*a* and 100*b*. The lever member 230 may, however, be engaged with any suitable location other than the main engagement part 120 of each of the first and the second cartridges 100*a* and 100*b*. For example, the lever member 230 may be engaged with a step section provided on the wall surface of each of the first and the second cartridges 100*a* and 100*b*.

H4. Modification 4

In the first embodiment described above, the lever member 230 is attached to the holder structure 200 such that the bridging section 232 is located above and the rotation axis RX is located below. Alternatively the lever member 230 may be attached to the holder structure 200 such that the bridging section 232 is located below and the rotation axis RX is located above. In this modification, the bridging section 232 may be configured to hold downward an engagement surface provided at the lower edge of each of the first and the second cartridges 100*a* and 100*b*, so as to limit the upward motion of each of the first and the second cartridges 100*a* and 100*b*.

H5. Modification 5

In the first embodiment described above, the lever member 230 is provided on the front wall 202 of the holder structure 200. The lever member 230 may, however, be provided on any suitable location other than the front wall 202 of the holder structure 200. For example, the lever member 230 may be provided on the rear wall 203 of the holder structure 200.

H6. Modification 6

In the first embodiment described above, the holder structure 200 is configured to allow for attachment of the first and the second cartridges 100*a* and 100*b*. The holder structure 200 may, however, be configured to allow for attachment of only a single cartridge or may be configured to allow for attachment of three or more cartridges.

H7. Modification 7

In the first embodiment described above, the device-side terminal assembly 250 is located at the position aligned with the first and the second leg sections 231*a* and 231*b* of the lever member 230 viewed in the direction of the arrow X as shown in FIG. 8. The device-side terminal assembly 250 may, however, be located at any other suitable position. For example, the device-side terminal assembly 250 may be arranged to be located between the first leg section 231*a* and the second leg section 231*b* of the lever member 230 viewed in the direction of the arrow Y and to be located forward from the first and the second leg sections 231*a* and 231*b* viewed in the direction of the arrow X. The direction along the direction of the arrow Y may be interpreted as the direction along the direction of rotation and move of the lever member 230 in the configuration of the first embodiment. In another example, the device-side terminal assembly 250 may be located at the position adjacent to the lever member 230 in the direction of the arrow X.

H8. Modification 8

In the first embodiment described above, the holder structure 200 is configured to cause the first and the second cartridges 100*a* and 100*b* to be attached along the locus of rotation and move about the upper edge of the rear wall 203 as the supporting point as shown in FIGS. 22 and 23. The holder structure 200 may, however, be configured not to cause the first and the second cartridges 100*a* and 100*b* to be attached along the locus of rotation and move about the upper edge of the rear wall 203 as the supporting point. The holder structure 200 may be configured to cause the first and the second cartridges 100*a* and 100*b* to be attached downward along a linear locus.

H9. Modification 9

In the embodiments described above, the pressing mechanisms 239 are provided at the lower edges of both the first and the second leg sections 231*a* and 231*b* of the lever member 230. One modification may omit the pressing mechanism 239 at either one of the first and the second leg sections 231*a* and 231*b*. Another modification may omit the pressing mechanisms 239 of both the first and the second leg sections 231*a* and 231*b*.

H10. Modification 10

In the first embodiment described above, the lever member 230 has the extension sections 234 on both the first and the second leg sections 231*a* and 231*b*. One modification may omit the extension section 234 at either one of the first and the second leg sections 231*a* and 231*b*. Another modification may omit the extension sections 234 of both the first and the second leg sections 231*a* and 231*b*.

H11. Modification 11

In the first embodiment described above, the lever member 230 is rotated about the convexes 235 provided at the respective lower edges of the first and the second leg sections 231*a* and 231*b* as the rotating shaft. The lever member 230 may, however, be rotated by any suitable technique other than that using the rotating shaft. The lever member 230 may have any configuration as long as the bridging section 232 is made to be rotatable and movable. For example, the bridging section 232 may be made to be rotatable and movable by defining the motion of the first and the second leg sections 231*a* and 231*b* by curve guide rails. In other words, the rotation and the move of the bridging section 232 includes swing of the bridging section 232.

H12. Modification 12

In the first embodiment described above, the two terminal lines, i.e., upper line and lower line, are arrayed on the terminal assembly surface 251 and on the terminal assembly rear face 252 of the device-side terminal assembly 250. The device-side terminal assembly 250 may however, have only a single terminal line or may have three or more terminal lines arrayed in the vertical direction. The respective terminals 261 to 269 and 271 to 279 of the device-side terminal assembly 250 may be arranged not in lines.

H13. Modification 13

In the first embodiment described above, the conductive element 258 of the device-side terminal assembly 250 has the folded area 258*t* at the lower end of the device-side terminal assembly 250. Alternatively the conductive element 258 may have a folded area 258*t* at the upper end of the device-side terminal assembly 250 or may have a folded area 258*t* on the side surface of the device-side terminal assembly 250. The conductive element 258 of the device-side terminal assembly 250 may not be made by the leaf spring but may be made by a helical spring or a torsion spring to apply the pressing force or may be made by a simple wire that does not give the pressing force.

H14. Modification 14

In the first embodiment described above, the first and the second cartridges 100*a* and 100*b* provided as ink containers in the approximately rectangular parallelepiped shape and configured to have the six walls 101 to 106 are attached to the holder structure 200. Alternatively an ink cartridge formed in a shape other than the approximately rectangular parallelepiped shape and configured not to have all the six walls 101 to 106 may be attached to the holder structure 200. Each of the first and the second cartridges 100*a* and 100*b* attached to the holder structure 200 may be formed, for example, as a hexahedron in an approximately trapezoidal shape viewed in the direction of the arrow X (in the side view) or as an approximately circular disk in an approximately elliptical shape in the side view. Each of the walls 101 to 106 defining the outer shape of each of the first and the second cartridges 100*a* and 100*b* may not have a flat surface or a smooth surface but may have some concavo-convex shape. Each of the walls 101 to 106 may not be extended as a planar surface but may have some cut or crack. Each of the walls 101 to 106 may be bent to have a substantially curved surface. Additionally, the respective walls 101 to 106 may have flexibility and may be provided as a frame to hold a bag-like member containing ink.

H15. Modification 15

In the first embodiment described above, each of the cartridges 100*a* and 100*b* has the first side wall portion 125 and the second side wall portion 126 which come into contact with and press the lever member 230 in the course of attachment to the holder structure 200. Either one of the first side wall portion 125 and the second side wall portion 126 may, however, be omitted, or both the first side wall portion 125 and the second side wall portion 126 may be omitted. Each of the cartridges 100*a* and 100*b* may not have a location which comes into contact with the lever member 230 in the course of attachment to the holder structure 200. In this modification, each of the cartridges 100*a* and 100*b* may be attached in the state that the lever member 230 is rotated and moved in the direction away from the cartridge chamber 210 by the user's operation.

H16. Modification 16

In the second embodiment described above, the first projection 281*a* and the second projection 281*b* are provided as walls extended in the direction of the arrow X. The first projection 281*a* and the second projection 281*b* may, however, not be provided as the walls. For example, the first projection 281*a* and the second projection 281*b* may be provided as semispherical or columnar convexes protruded in the direction of the arrow Z. Although the first projection 281*a* and the second projection 281*b* have the same shape in the above second embodiment, the first projection 281*a* and the second projection 281*b* may not have the same shape. For example, only the first projection 281*a* may have a semispherical shape. The first projection 281*a* and the second projection 281*b* may be formed as walls of different lengths in the direction of the arrow X. In the application that the main engagement part 120 has a concavo-convex upper surface, the first projection 281*a* and the second projection 281*b* may be adjusted to different heights or different shapes according to the shape of the abutting part of the main engagement part 120.

H17. Modification 17

In the second embodiment described above, the first projection 281*a* and the second projection 281*b* are formed at the positions respectively adjacent to the first leg section 231*a* and the second leg section 231*b*. The first projection 281*a* and the second projection 281*b* may, however, be formed at positions respectively away from the first leg section 231*a* and the second leg section 231*b*. In the above second embodiment, the first projection 281*a* and the second projection 281*b* are aligned on the same axis in the direction of the arrow X. The first projection 281*a* and the second projection 281*b* may, however, not be aligned on the same axis in the direction of the arrow X. The direction of alignment of the first projection 281*a* and the second projection 281*b* may be a direction inclined to the direction of the arrow X. The positions of the first projection 281*a* and the second projection 281*b* may be offset from each other in the direction of the arrow Y.

H18. Modification 18

The lever member 230*s* of the above second embodiment has the stopping wall 285 as the rotation limiter. The rotation limiter may, however, not be formed in a wall shape like the stopping wall 285. The rotation limiter of the lever member 230*s* may be formed as a convex part, for example, in a columnar shape protruded from the bridging section 232, the first leg section 231*a* or the second leg section 231*b*. The rotation limiter should be any configuration that comes into contact with each of the cartridges 100*a* and 100*b* to limit the rotation and the move of the bridging section 232 of the lever member 230*s* toward each cartridge 100*a* or 100*b*.

H19. Modification 19

In the second embodiment described above, the stopping wall 285 working as the rotation limiter is extended downward from the lower surface of the bridging section 232. The rotation limiter may, however, be not extended downward from the lower surface of the bridging section 232. The rotation limiter may be provided separately from the bridging section 232. The rotation limiter may be formed, for example, as a wall extended from at least one of the first leg section 231*a* and the second leg section 231*b* toward the center of the lever member 230*s* in the direction of the arrow X.

H20. Modification 20

Any of modifications 1 to 15 with regard to the above first embodiment may also be applied to the second embodiment, Modifications 16 to 20 of the second embodiment and the other embodiments described above. The first projection 281*a*, the second projection 281*b* and the rotation limiter described in the second embodiment and its Modifications 16 to 20 may also be applied to the lever member 230A of the third embodiment or to the lever member 230B of the fourth embodiment described above. The first projection 281*a*, the second projection 281*b* and the rotation limiter may also be applied to the lever member 230 included in the holder structure 200C of the fifth embodiment or in the holder structure 200 of the sixth or the seventh embodiment.

H21. Modification 21

In the embodiments and modifications described above, the holder structure configured to attach an ink supply unit to the printing device 10 having the liquid ejection mechanism for ejecting ink is described as the liquid supply unit mounting mechanism of the invention. The liquid supply unit mounting mechanism of the invention may also be configured as a mounting mechanism for attaching a liquid supply unit other than the ink supply unit. The liquid supply unit mounting mechanism of the invention may be provided, for example, as a mounting mechanism of a cleaning liquid supply unit to supply a cleaning liquid to a high-pressure cleaning machine to spray a liquid such as a cleaning liquid onto an object to be cleaned and clean the object.

The invention is not limited to any of the embodiments, the examples and the modifications described herein but may be implemented by a diversity of other configurations without departing from the scope of the invention. For example, the technical features of the embodiments, examples or modifications corresponding to the technical features of the respective aspects described in Summary may be replaced or combined appropriately, in order to solve part or all of the problems described above or in order to achieve part or all of the advantageous effects described above. Any of the technical features may be omitted appropriately unless the technical feature is described as essential herein.

The invention claimed is:

1. A liquid supply unit mounting mechanism comprising:

a liquid introducing part configured to introduce a liquid supplied from a liquid supply port of a liquid supply unit; and a rotation mechanism configured to be engaged with the liquid supply unit, wherein the rotation mechanism comprises a first leg section, a second leg section formed away from the first leg section, and a bridging section formed between the first leg section and the second leg section, the rotation mechanism is configured to let the liquid supply unit stop at the bridging section, the bridging section is configured to be rotatable and movable in a direction away from the liquid introducing part, and an electrode assembly configured to be in electrical contact with the liquid supply unit, the electrode assembly located between the first leg section and the second leg section when viewed in a direction of rotating and moving the bridging section.

2. The liquid supply unit mounting mechanism according to claim 1, wherein a distance from the bridging section to a rotation axis of the rotation mechanism is longer than a distance from the bridging section to the electrode assembly.

3. The liquid supply unit mounting mechanism according to claim 2, wherein the electrode assembly is configured to have a plurality of electrodes arranged to be electrically in contact with the liquid supply unit, and the rotation mechanism is configured to have an extension section provided on at least the first leg section, wherein the extension section has an outer peripheral edge located at a position closer to an area where the liquid supply unit is attached than at least part of the plurality of electrodes, in a state that the liquid supply unit is not attached to the liquid supply unit mounting mechanism.

4. The liquid supply unit mounting mechanism according to claim 3, wherein the extension section is extended along an attachment direction of the liquid supply unit in the course of attachment of the liquid supply unit.

5. The liquid supply unit mounting mechanism according to claim 2, wherein the bridging section is configured to have an abutting part which comes into contact with the liquid supply unit, such as to limit move of the liquid supply unit in a direction of making the liquid supply port of the liquid supply unit away from the liquid introducing part, in a state that the liquid supply unit is attached to the liquid supply unit mounting mechanism.

6. The liquid supply unit mounting mechanism according to claim 5, wherein the abutting part has a first projection and a second projection which comes into contact with the liquid supply unit, in the state that the liquid supply unit is attached to the liquid supply unit mounting mechanism.

7. The liquid supply unit mounting mechanism according to claim 2, wherein the rotation mechanism comprises a rotation limiter configured to come into contact with the liquid supply unit and thereby limit rotation and movement of the bridging section toward the liquid introducing part, in a state that the liquid supply unit is attached to the liquid supply unit mounting mechanism.

8. The liquid supply unit mounting mechanism according to claim 2, wherein the first leg section has a first rotating shaft member, the second leg section has a second rotating shaft member, and the rotation mechanism is configured to be rotatable about the first rotating shaft member and the second rotating shaft member as a rotation axis.

9. The liquid supply unit mounting mechanism according to claim 2, wherein the rotation mechanism has a first pressing member configured to press the first leg section in a rotating direction and a second pressing member configured to press the second leg section in a rotating direction.

10. The liquid supply unit mounting mechanism according to claim 2, wherein the bridging section has an operating part configured to be operable by the user to rotate the rotation mechanism and the bridging section is located at a middle position between the first leg section and the second leg section.

11. A liquid supply unit configured to be attachable to the liquid supply unit mounting mechanism according to any one of claims 1 and 2 to 10, the liquid supply unit comprising:

a contact area configured to come into contact with the rotation mechanism and thereby rotate and move the bridging section in a direction away from the liquid introducing part in the course of attachment of the liquid supply unit to the liquid supply unit mounting mechanism; and an electrical terminal configured to be in electrical contact with the electrode assembly of the liquid supply unit mounting mechanism, the electrical terminal to be located between the first leg section and the second leg section of the liquid supply unit mounting mechanism when the liquid supply unit is attached to the liquid supply unit mounting mechanism and viewed in a direction of rotating and moving the bridging section.

12. The liquid supply unit according to claim 11, further comprising:

an exterior assembly configured to have a liquid chamber formed to contain a liquid and the liquid supply port.

13. The liquid supply unit according to claim 11, further comprising:

a first member configured to have the liquid supply port; and a second member configured to be connectable with the first member and have a liquid chamber formed to contain a liquid inside thereof.

14. The liquid supply unit according to claim 11, further comprising:

a first member configured to have the liquid supply port; and a second member configured to be connected with the liquid supply port and supply a liquid through the liquid supply port.

15. A liquid supply unit configured to be attachable to a liquid supply unit mounting mechanism:

the liquid supply unit mounting mechanism including:

a liquid introducing part, a rotation mechanism having a first leg section, a second leg section formed away from the first leg section, and a bridging section formed between the first leg section and the second leg section, and an electrode assembly located between the first leg section and the second leg section when viewed in a direction of rotating and moving the bridging section, wherein the bridging section is configured to be rotatable and movable in a direction away from the liquid introducing part, and a distance from the bridging section to a rotation axis of the rotation mechanism is longer than a distance from the bridging section to the electrode assembly, the liquid supply unit comprising:

a first wall on which a liquid supply port is provided, the liquid supply port being configured to supply a liquid to the liquid introducing part;

a second wall opposed to the first wall;

a third wall intersecting with the first wall and the second wall; and a fourth wall intersecting with the first wall and the second wall and opposed to the third wall and on which an engagement part and a terminal are arranged, the engagement part being located closer to the second wall than the first wall and configured to be stopped at the bridging section of the rotation mechanism in a state that the liquid supply unit is attached to the liquid supply unit mounting mechanism, the terminal being configured to be electrically in contact with the electrode assembly.

16. The liquid supply unit of claim 15, configured to be attachable to the liquid supply unit mounting mechanism of claim 1.

17. The liquid supply unit of claim 15, combined with and attached to the liquid supply unit mounting mechanism of claim 1.

* * * * *